United States Patent [19]

Tsuchitani et al.

[11] Patent Number: 4,925,547

[45] Date of Patent: May 15, 1990

[54] PROCESS FOR PRODUCING PITCH FOR THE MANUFACTURE OF HIGH-PERFORMANCE CARBON FIBERS TOGETHER WITH PITCH FOR THE MANUFACTURE OF GENERAL-PURPOSE CARBON FIBERS

[75] Inventors: Masatoshi Tsuchitani, Ichihara; Sakae Naito, Chiba; Hiroshi Morijiri; Kiyotaka Suzuki, both of Ichihara, all of Japan

[73] Assignee: Maruzen Petrochemical Co., Ltd., Tokyo, Japan

[21] Appl. No.: 397,135

[22] Filed: Aug. 21, 1989

[30] Foreign Application Priority Data

Aug. 25, 1988 [JP] Japan ..... 63-211494

[51] Int. Cl.[5] ..... C10C 3/00

[52] U.S. Cl. ..... 208/39; 208/40; 208/45; 208/44; 423/447.1; 423/447.2; 423/447.4

[58] Field of Search ..... 208/39, 40, 45; 423/447.1, 447.2, 447.4

[56] References Cited

U.S. PATENT DOCUMENTS

| | | | |
|---|---|---|---|
| 4,271,006 | 6/1981 | Dickakian | 208/40 |
| 4,402,928 | 9/1983 | Lewis et al. | 208/45 |
| 4,443,324 | 4/1984 | Diefendorf et al. | 208/45 |
| 4,502,943 | 3/1985 | Dickakian | 208/40 |
| 4,522,701 | 6/1985 | Dickakian | 208/40 |
| 4,575,412 | 3/1986 | Yudate et al. | 208/45 |
| 4,578,177 | 3/1986 | Yudate et al. | 208/45 |
| 4,597,853 | 7/1986 | Moriya et al. | 208/22 |
| 4,663,021 | 5/1987 | Arai et al. | 208/67 |
| 4,820,401 | 4/1989 | Buchilani et al. | 208/40 |

FOREIGN PATENT DOCUMENTS

| | | |
|---|---|---|
| 657120 | 5/1929 | France . |
| 58-18421 | 2/1983 | Japan . |
| 58-196292 | 11/1983 | Japan . |
| 58-214531 | 12/1983 | Japan . |

*Primary Examiner*—Helane Myers

*Attorney, Agent, or Firm*—Frishauf, Holtz, Goodman & Woodward

[57] ABSTRACT

A process for co-production of a pitch for the manufacture of HP carbon fibers and a pitch for the manufacture of GP carbon fibers is proposed. The pitch for the manufacture of GP carbon fibers is prepared from the spent fraction not used in the production of an optically anisotropic pitch suitable for the manufacture of HP carbon fibers. The spent fraction has hitherto been discarded as a valueless material. According to the present process, a pitch for the manufacture of so-called ultra HP carbon fibers with tensile strength of over 400 Kg/mm$^2$ and modulus of elasticity of over 60 ton/mm$^2$ and a pitch for the manufacture of GP carbon fibers can be produced simultaneously. Both pitches have very excellent spinnability and when they are spun, they cause no fiber cut-off even at a high spinning rate of, for example, 500 m/min or 700 m/min. One important merit of the process is that the production ratio of ultra HP carbon fibers and GP carbon fibers can easily be changed to accommodate to market's demand. Accordingly, the process has wide flexibility in operation. Of course, the effective utilization of valueless spent fraction can reduce the production costs of not only ultra HP carbon fibers but also GP carbon fibers.

40 Claims, 5 Drawing Sheets

PROCESS FOR PRODUCING PITCH FOR THE MANUFACTURE OF HIGH-PERFORMANCE CARBON FIBERS TOGETHER WITH PITCH FOR THE MANUFACTURE OF GENERAL-PURPOSE CARBON FIBERS

BACKGROUND OF THE INVENTION

1. Field of the Invention

This invention relates to a process for producing a pitch for the manufacture of high-performance carbon fibers, especially suitable for the manufacture of ultra high-performance carbon fibers, together with a pitch for the manufacture of general-purpose carbon fibers from a single heavy oil raw material of coal or petroleum origin.

2. Description of the Prior Art

Carbon fibers are conventionally classified into high-performance carbon fibers and general-purpose carbon fibers based on its mechanical strength. That is, carbon fibers having the strength of approximately 200–350 $Kg/mm^2$ and modulus of elasticity of approximately 10–40 $ton/mm^2$ are classified into the high-performance carbon fiber. These are directed to such applications as special parts material for rockets or aircraft, golf clubs, tennis rackets, fishing rods, and the like. On the other hand, those having the strength of approximately 70–140 $Kg/mm^2$ and modulus of elasticity of approximately 3–10 $ton/mm^2$ are classified into the general-purpose carbon fibers. They are used, for example, as thermal insulators, antistatic materials, sliding materials, filters, packings, and the like.

The recent expansion of the field to which carbon fibers are applied and the technological advance in the applications, however, require a further improvement in the mechanical strength of these materials. For example, ultra high-performance carbon fibers having the strength of the order of 300–600 $Kg/mm^2$ are demanded. There also exist a wide variety of applications for general-purpose carbon fibers depending on its quality and performance. A more economical way of manufacturing this grade of carbon fibers is also desired.

Development of a simple process for preparing high-performance carbon fibers, especially ultra high-performance carbon fibers, together with general-purpose carbon fibers, using a single cheap raw material, for instance, a heavy oil of coal or petroleum origin is desired. Especially, it is meritorious that if general-purpose carbon fibers can be prepared from the spent fractions of the heavy oil which could not be utilized for the manufacture of high-performance carbon fibers in the past and was hitherto considered as valueless materials. If a process for co-production of high-performance carbon fibers and general-purpose carbon fibers is developed, it would have merits not only of production of high-performance carbon fibers, but also of lower production cost of general-purpose carbon fibers. Such a process would also contribute the reduction of production cost of high-performance carbon fibers. Thus, the process would be of tremendous industrial significance. No processes for sufficiently achieving these objectives, however, have ever been proposed.

In the followings, the terms "high-performance" and "general-purpose" are occasionally abbreviated as "HP" and "GP", respectively.

The reason why a process for co-production of HP carbon fibers and GP carbon fibers has not yet been proposed is believed as follows: That is, the reason is greatly attributable to the great difference in requisite for the pitch to be used in the production of HP carbon fibers and requisite for the pitch to be used in the production of GP carbon fibers. In preparing the HP carbon fibers from a pitch, the spinning pitch must be a so-called mesophase pitch which contains, as a major component, the substance exhibiting an optically anisotropic phase when examined on a polarizing microscope near the ambient temperature. On the contrary, the pitch for the production of GP carbon fibers is an entirely optically isotropic pitch which does completely not contain the optically anisotropic portion.

This mesophase is a kind of liquid crystals which is formed when a heavy oil or a pitch is heat-treated, and its optically anisotropic character is due to an agglomerated layered structure of thermally polymerized planar aromatic molecules. Further, the agglomerated layered structure of planar aromatic molecules have a property easily to form orientation and the property just mentioned above has an important role when carbon fibers are prepared from the pitch. When such mesophase pitch is subjected to melt spinning, the planar aromatic molecules are aligned to the direction of the fiber axis due to the stress exerted to the melt as it passes through a nozzle hole, and this oriented structure can be kept without being disrupted throughout subsequent steps to render it infusible and carbonization steps, and therefore, high-performance carbon fibers with high tensile strength and high modulus of elasticity and having good orientation can be obtained. Therefore, when the production of high-performance carbon fibers with high tensile strength and high modulus of elasticity is desired, it is necessary to use an optically anisotropic pitch as the raw material. Accordingly, it is an important task in the art that how the optically anisotropic pitches with good spinnability are prepared.

It is to be understood that the term "mesophase" used in the art is a synonym of "optically anisotropic phase" or "optically anisotropic portion" and the term "mesophase pitch" is a synonym of "optically anisotropic pitch".

In most of the cases, however, this optically anisotropic portion is different from the non-oriented, optically isotropic portion in its viscosity, specific gravity, etc. A pitch containing, for example, a small amount of optically anisotropic portion mixed with optically isotropic portion, even if heated to melt at a temperature at which the optically isotropic portion becomes a viscosity to be easily spun, cannot be spun in a stable manner because of the existence of the small amount of optically anisotropic portion having a considerably high viscosity at this temperature. For the manufacturing of general-purpose carbon fibers from an optically isotropic pitch, therefore, the absence of optically anisotropic portion in the optically isotropic pitch is imperative. For the preparation of GP carbon fibers, it is therefore very important to suppress the formation of optically anisotropic portion in the optically isotropic pitch.

Although pitches for the manufacture of HP and GP carbon fibers are common in that both are spinning pitches, they are completely different from each other in that the one allows the existence of optically anisotropic portion while the other does not. This would be the reason that no attempts have ever been undertaken to develop a process which can produce both of these two pitches at the same time.

SUMMARY OF THE INVENTION

In view of this situation of the carbon fiber manufacturing industries, an object of the present invention is to provide a process which can produce a pitch for the manufacture of high-performance carbon fibers, especially of ultra high-performance carbon fibers, from a heavy oil raw material of coal or petroleum origin, and, which, at the same time, can produce a pitch for the manufacture of general-purpose carbon fibers from the remaining fractions of the heavy oil which have not been utilized for the manufacture of the pitch for high-performance carbon fibers.

The pitch for the manufacture of high-performance carbon fibers prepared by the process of this invention is substantially optically anisotropic when observed on a polarizing microscope at a temperature near room temperature and exhibits good spinning performance. It can produce high-performance carbon fibers having high tensile strength and high modulus of elasticity by usual techniques of melt spinning, infusion, and carbonization or graphitization. On the other hand, the pitch for the manufacture of general-purpose carbon fibers prepared by the process of this invention is essentially optically isotropic when observed on a polarizing microscope at a temperature near room temperature, and can produce general-purpose carbon fibers having a good quality by usual techniques of melt spinning, infusion, and carbonization.

In addition to the provision of such a process which has been conceived by us through investigations to accommodate the demands in the present carbon fiber industries, further studies by us resulted in the development of a scheme for producing a pitch for the manufacture of carbon fibers, which constitutes a preferred embodiment of this invention. That is, in a process, for example, the process previously proposed by us for the manufacture of high-performance carbon fibers which is described in Japanese Patent Laid-open No. Sho 62(1987)-270685; which comprises heat-treating a refined heavy oil of coal or petroleum origin under specified conditions, adding a certain amount of a monocyclic aromatic hydrocarbon solvent or a solvent having the same degree of dissolving ability with the monocyclic aromatic hydrocarbon solvent to the heat-treated material, separating and recovering the produced insoluble component, hydrogenating the insoluble component under heat treatment in the presence of hydrogen-donating solvent, and producing an optically anisotropic pitch by a final heat treatment of the hydrogenated pitch; the finding of us comprises producing a pitch for producing general-purpose carbon fibers from the soluble component which remains after the separation and recovery of the insoluble component produced by the addition of said certain amount of monocyclic aromatic hydrocarbon solvent.

Other objects of this invention will be apparent to the persons in the art from the detailed descriptions and preferred embodiment given hereunder and the figures attached hereto.

Thus, the gist of this invention resides in a process for producing a pitch for the manufacture of high-performance carbon fibers together with a pitch for the manufacture of general-purpose carbon fibers, which comprises using, as a raw material, a heavy oil of coal origin or petroleum origin, or a heavy component obtained by the distillation, heat treatment or hydrogenation of the heavy oil of coal origin or petroleum origin, which contains essentially no component insoluble in a monocyclic aromatic hydrocarbon solvent or from which such component insoluble in a monocyclic aromatic hydrocarbon solvent has been essentially removed;

subjecting said raw material to a first step of continuously heat-treating said raw material in a tubular heater under an increased pressure at a temperature of 400°-600° C. to produce a heat-treated material containing essentially no quinoline insoluble component and 3-30% by weight of xylene insoluble component;

subjecting said heat-treated material produced in the first step to a second step of adding 1-5 parts by weight of a monocyclic aromatic hydrocarbon solvent or a solvent having the same degree of dissolving ability with the monocyclic aromatic hydrocarbon solvent to 1 part by weight of said heat-treated material, thus producing insoluble component and separating the insoluble component and the solution of soluble component in said solvent;

subjecting said insoluble component separated in the second step to a third step of hydrogenating said insoluble component with heating in the presence of a hydrogen-donating solvent to produce a hydro-treated mixture;

thereby obtaining a hydro-treated mixture from the third step and obtaining a solution of soluble component in the monocyclic aromatic hydrocarbon solvent from the second step;

treating said hydro-treated mixture to produce a substantially optically anisotropic pitch for the manufacture of high-performance carbon fibers; and treating said solution of soluble component in said solvent to produce an essentially optically isotropic pitch for the manufacture of general-purpose carbon fibers.

The process for producing a pitch for the manufacture of high-performance carbon fibers together with a pitch for the manufacture of general-purpose carbon fibers of this invention includes many embodiments and one of the embodiments is as follows:

A process for producing a pitch for the manufacture of high-performance carbon fibers together with a pitch for the manufacture of general-purpose carbon fibers, which comprises using, as a raw material, a heavy oil of coal origin or petroleum origin, or a heavy component obtained by the distillation, heat treatment or hydrogenation of the heavy oil of coal origin or petroleum origin, which contains essentially no component insoluble in a monocyclic aromatic hydrocarbon solvent or from which such component insoluble in a monocyclic aromatic hydrocarbon solvent has been essentially removed;

subjecting said raw material to a first step of continuously heat-treating said raw material in a tubular heater under an increased pressure at a temperature of 400°-600° C. to produce a heat-treated material containing essentially no quinoline insoluble component and 3-30% by weight of xylene insoluble component;

subjecting said heat-treated material produced in the first step to a second step of adding 1-5 parts by weight of a monocyclic aromatic hydrocarbon solvent or a solvent having the same degree of dissolving ability with the monocyclic aromatic hydrocarbon solvent to 1 part by weight of said heat-treated material, thus producing insoluble component and continuously separating the insoluble component and the solution of soluble component in said solvent;

subjecting said insoluble component separated in the second step to a third step of hydrogenating said insoluble component with heating in the presence of a hydrogen-donating solvent to produce a hydro-treated mixture;

subjecting said hydro-treated mixture produced in the third step to a fourth step of removing said hydrogen-donating solvent and a portion of light fractions from the hydro-treated mixture to produce a hydrogenated pitch which is essentially optically isotropic;

subjecting said essentially optically isotropic hydrogenated pitch produced in the fourth step to a fifth step of heat-treating said hydrogenated pitch to produce a substantially optically anisotropic pitch for the manufacture of high-performance carbon fibers;

subjecting said solution of soluble component in said monocyclic aromatic hydrocarbon solvent separated in the second step to a sixth step of removing said monocyclic aromatic hydrocarbon solvent or said solvent having the same degree of dissolving ability with the monocyclic aromatic hydrocarbon solvent from said solution of soluble component to obtain soluble component;

subjecting said soluble component obtained in the sixth step to a seventh step of removing light fractions from said soluble component to produce a soluble pitch; and subjecting said soluble pitch produced in the seventh step to an eighth step of heat-treating said soluble pitch to produce a heat-treated pitch which is an essentially optically isotropic pitch for the manufacture of general-purpose carbon fibers.

DETAILED DESCRIPTION OF THE INVENTION

Figure 1:
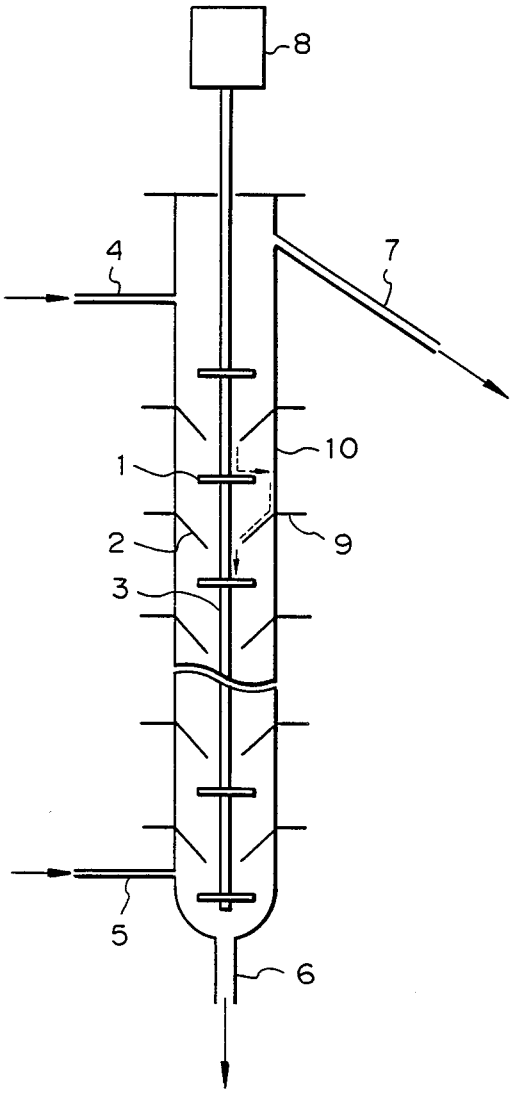
FIG. 1 is a simplified schematic cross-sectional view of a preferred apparatus for suitably carrying out the continuous dispersion-heat-treatment.

For the convenience of description, the process of this invention will be materially described mainly onto the embodiment mentioned above and other embodiments will be described somewhat briefly as modifications of the first embodiment.

As the raw materials used in the present invention, heavy oils of coal origin, heavy oils of petroleum origin and pitches obtainable therefrom can be cited. The term "heavy oil of coal origin" as used herein means coal tars, liquefied coals, and the like, the term "heavy oil of petroleum origin" as used herein means residue of naphtha cracking (naphtha tar), residue of gas oil cracking (pyrolysis tar), residue of fluidized catalytic cracking (decant oil), and the like, and the term "pitch" as used herein means a heavier fraction of the heavy oils and is obtainable from the heavy oils by distillation, heat treatment, hydro-treatment, or the like. Any mixture of the heavy oil and/or the pitch can also be used. In the followings, the heavy oils, the pitches or mixtures thereof are collectively referred to as "Heavy Oil(s)".

Chemical and physical characteristics of some kinds of Heavy Oil are shown in Table 1.

TABLE 1 (1)

| Kind of heavy oil | Coal tar | Naphtha tar | Pyrolysis tar |
|---|---|---|---|
| Sp.Gr. (15/4° C.) | 1.10–1.20 | 1.05–1.10 | 1.05–1.15 |
| Viscosity (cSt. at 100° C.) | 1–200 | 5–100 | 2–250 |
| H/C atomic ratio | 0.6–0.8 | 0.9–1.0 | 0.8–1.2 |
| Asphaltene (wt. %) | 15–40 | 10–20 | 10–25 |
| Xylene insolubles (wt. %) | 2–20 | 0–1 | 0–10 |
| Quinoline insolubles (wt. %) | 0.1–5.0 | less than 1 | less than 1 |
| Conradson carbon (wt. %) | 15–30 | 10–20 | 10–25 |
| Distillation (°C.) | | | |
| IBP | 180–250 | 170–210 | 180–250 |
| 10 vol. % | 210–300 | 210–240 | 240–320 |
| 30 vol. % | 270–370 | 230–280 | 270–340 |
| 50 vol. % | 360–420 | 270–350 | 330–390 |
| 70 vol. % | 470–530 | 320–400 | 380–460 |

TABLE 1 (2)

| Kind of heavy oil | Decant oil | Hydrogenated coal tar |
|---|---|---|
| Sp.Gr. (15/4° C.) | 0.95–1.10 | 1.10–1.20 |
| Viscosity (cSt. at 100° C.) | 2–50 | 1–50 |
| H/C atomic ratio | 1.2–1.5 | 0.8–1.0 |
| Asphaltene (wt. %) | 0–5 | 10–30 |
| Xylene insolubles (wt. %) | 0–1 | 1–10 |
| Quinoline insolubles (wt. %) | less than 1 | 0–2.0 |
| Conradson carbon (wt. %) | 2–10 | 10–25 |
| Distillation (°C.) | | |
| IBP | 170–240 | 160–270 |
| 10 vol. % | 300–370 | 200–350 |
| 30 vol. % | 350–400 | 250–410 |
| 50 vol. % | 370–420 | 350–470 |
| 70 vol. % | 400–450 | 460–550 |

The raw material to be fed to the heat treatment in a tubular heater in the first step of the process of the present invention should be the Heavy Oil which contains essentially no materials insoluble in a monocyclic aromatic hydrocarbon solvent or the Heavy Oil from which the materials insoluble in a monocyclic aromatic hydrocarbon solvent have already been removed essentially. The term "a Heavy Oil which contains essentially no materials insoluble in a monocyclic aromatic hydrocarbon solvent" used herein means a Heavy Oil which produces essentially no insoluble materials, when mixed with 1–5 times amount by weight of a monocyclic aromatic hydrocarbon solvent, i.e., when 1 weight part of the Heavy Oil is mixed with 1–5 weight parts of a monocyclic aromatic hydrocarbon solvent. Similarly, the term "a Heavy Oil from which the materials insoluble in a monocyclic aromatic hydrocarbon solvent have already been removed essentially" used herein means a Heavy Oil which has already been treated with 1–5 times amount by weight of a monocyclic aromatic hydrocarbon solvent or a solvent having the equivalent dissolving ability to the monocyclic aromatic hydrocarbon solvent so as to remove essentially all insoluble materials formed thereby. In the followings, the Heavy Oil having the characteristics explained above is occasionally referred to "Refined Heavy Component". Depending upon the origin of Heavy Oils and the history of processings received, there are two types of Heavy Oils, one is a Heavy Oil which forms essentially no insolubles when mixed with 1–5 times amount by weight of a monocyclic aromatic hydrocarbon solvent and the other is a Heavy Oil which forms some or substantial amount of insolubles when mixed with 1–5 times amount by weight of the monocyclic aromatic hydrocarbon solvent. The former can be fed directly to the first step of the process of this invention. Relative to the latter, however, it is necessary to remove the insoluble materials prior to feed the Heavy Oil to the first step of the present invention. More material descriptions will be given hereunder relative to the Refined Heavy Component to be fed to the first step of the present invention.

The term "monocyclic aromatic hydrocarbon solvent" herein used means benzene, toluene, xylene, ethylbenzene etc. They may be used either alone or as a mixture thereof. These solvents are, of course, not necessarily pure compounds, and it is sufficient that if they contain substantial amount of these compounds. The solvent used for the separation of insoluble materials from a raw material Heavy Oil or the separation conducted in the second step, i.e., separation of insoluble component and the solution of soluble component in the solvent (hereinafter occasionally referred to "solvent solution of soluble component") contained in the heat-treated material obtained in the first step, is not limited to the benzene, toluene, xylene, ethylbenzene, and the like. For example, a mixed solvent having a dissolving ability which being equivalent or substantially equivalent to the dissolving ability of benzene, toluene, xylene, ethylbenzene, and the like can be used without any difficulties. Such a mixed solvent can easily be prepared by simply mixing, in a suitable ratio, a poor solvent, such as n-hexane, n-heptane, acetone, methyl ethyl ketone, methanol, ethanol, kerosene, gas oil, naphtha, and the like with a good solvent, such as quinoline, pyridine, coal tar-gas oil, wash oil, carbonyl oil, anthracene oil, aromatic low-boiling point oil obtainable by distilling a heavy oil, etc. It is preferred, however, to use a solvent having a simple composition, such as benzene, toluene, xylene, ethylbenzene, and the like, so as to simplify the solvent recovering procedure. The combination of the above-mentioned poor and good solvents can be deemed to be the equivalent of a monocyclic aromatic hydrocarbon solvent such as benzene, toluene, xylene, ethylbenzene, and the like because of their equivalent dissolving ability. The aforementioned monocyclic aromatic hydrocarbon solvents, inclusive of the above combined solvents, are hereafter referred to simply as "BTX solvent(s)" or more simply as "BTX" in the description of this specification. Accordingly, it is to be noted that the term "BTX solvent(s)" or "BTX" used herein has somewhat wider scope than the term "BTX" commonly and usually used in the art.

The raw material to be fed to the heat treatment in a tubular heater in the first step of the process of the present invention should be the material that produces essentially no insoluble materials, when mixed with 1–5 times amount by weight of a BTX solvent, i.e., when 1 weight part of the raw material is mixed with 1–5 weight parts of a BTX solvent. Taking coal tars as an example, since coal tars are a heavy oil by-produced in the dry distillation of coal, they usually contain very fine soot-like carbons which are generally called free carbons. The free carbons are known to interfere with the growth of mesophase when Heavy Oil is heat-treated, and moreover, being a solid insoluble in quinoline, the free carbon becomes a cause of the fiber cut off in the spinning operation. Further, coal tars contain high-molecular weight materials insoluble in BTX solvent, and the high-molecular weight materials are easily converted into quinoline-insoluble component during a heat treatment. These BTX solvent-insoluble materials contained in coal tars vary in both their amount and quality depending on the production conditions of each coal tar. Since they are not produced specifically to be used as a raw material for producing carbon fibers, if they are extracted and used as a precursor of the spinning pitches, they may affect the properties of a spinning pitch and the characteristics of the produced carbon fibers on account of the variations in their properties. Removing free carbons and BTX solvent-insoluble materials from raw Heavy Oils is, therefore, important not only for preventing the formation of coke-like solid materials in the heat treatment in the tubular heater of the first step and clogging the tubes, but also for preventing the formation of a quinoline-insoluble (hereinafter occasionally abbreviated as "QI") component in the final product mesophase pitch, thus producing a spinning pitch with a stable property.

This removal of insoluble materials using a BTX solvent from raw Heavy Oils can be omitted, when the Heavy Oil contains essentially no materials insoluble in a BTX solvent. Heavy Oil of petroleum origin such as, for example, naphtha tar is generally composed of components soluble in the BTX solvent in its entirety, and further, there may be Heavy Oil, even if coal origin, which is completely or essentially free of materials insoluble in a BTX solvent for some reasons. These raw materials need not be subjected to the refining pretreatment mentioned above, because there is no or essentially no insoluble material to be removed by the refining pretreatment mentioned above, and therefore, there is no merit expected from this pretreatment. Such raw materials containing no or essentially no materials insoluble in a BTX solvent can be regarded as Heavy Oil latently received the pretreatment for removing the insoluble materials, and therefore, such raw materials are also within the scope of the definition of Refined Heavy Component. Even in the case where the above-mentioned refining pretreatment can be omitted, it is desirable in order to obtain a more homogeneous excellent quality mesophase pitch, i.e., optically anisotropic pitch, to subject the Heavy Oil to a heat treatment so that less than 10 wt %, based on the raw material, of xylene insoluble materials are formed, and then to separate and remove these formed insoluble materials. Either a batch process, e.g. heat treatment by the use of an autoclave, or a continuous process, e.g. heat treatment by the use of a tubular heater may be employed for the heat treatment. It is not efficient, however, that if the amount to be removed as a material insoluble in a BTX solvent becomes too large, because it may result lowering the yield of mesophase pitch, i.e., the ultimate product.

The quantity of the BTX solvent to be used for the separation of the insoluble material is preferably 1–5 times amount of the Heavy Oil to be treated. A deficient quantity would make the mixed liquid viscous, which will worsen the extraction efficiency. On the other hand, the use of too much solvent would make the total volume of the material to be treated larger, thereby making the process uneconomical. Usually, the desirable amount of a BTX solvent to be used is 1–3 times by weight of the Heavy Oil. The amount of the insoluble materials formed when a BTX solvent of 1–5 times by weight of the Heavy Oil is added and the amount of the insoluble materials formed when a larger amount of a BTX solvent, e.g. several tens of times by weight, is added (This is usually done when the amount of solvent-insoluble materials is measured as a parameter of the property of Heavy Oil.) are not always the same. When the amount of the solvent is small, the amount of the insoluble materials formed is also small. Therefore, when a Refined Heavy Component obtained by removing insoluble materials formed by the addition of a solvent of 1-5 times by weight, i.e., using (Heavy Oil/solvent) weight ratio of (1/1-5), is subjected to analysis using several tens of times by weight of the solvent, i.e., (Refined Heavy Component/solvent) weight ratio of (1/several tens), a small amount of insoluble materials can occasionally be detected. The presence of this type of insoluble materials does not have any adverse effect on the practice of the present invention.

Any method can be employed for separating the insoluble materials, including centrifugation, filtration, and the like. In case fine solid materials such as free carbon, catalyst, or other impurities are contained, however, filtration is a preferred method to completely eliminate these solid materials. A Refined Heavy Component can be obtained by distilling off BTX solvents from the solution which has been obtained from the mixture of a Heavy Oil and a BTX solvent by removing insoluble materials contained therein.

Another desirable characteristics demanded of the Refined Heavy Component to be charged into the first step is that it contains 10-70 wt. %, preferably 20-60 wt. %, of light fraction having a boiling point range of 200°-350° C., and its viscosity at 100° C. is not more than 1,000 cSt. A Refined Heavy Component which does not contain a light fraction with a boiling point below 350° C., even if it is free from any BTX-insoluble material, has so high melting point that it entails the inconvenience of maintaining the temperature of instrument, such as a pump, to be used to feed the material into the first step, high enough. Moreover, if such a Refined Heavy Component is heat-treated in the absence of a light fraction, the rate of thermal polymerization will become so large that solid materials such as cokes tend to be produced. The effect of the light fraction on the rate of thermal polymerization is already known in the art as described in Japanese Patent Laid-open No. Sho 59(1984)-82417 and U.S. Pat. No. 4,522,701. Even though generally available coal tar, naphtha tar, pyrolysis tar, and decant oil satisfy this requirement, it is desirable to prepare a pitch which is not excessively beyond the range of the aforementioned characteristics if these Heavy Oils are to be processed in advance by distillation, heat treatment, hydrogenation, or the like. It is possible, however, to use a Refined Heavy Component, which is completely free from a BTX-insoluble material but is outside the range of the aforementioned characteristics, by diluting with the addition of an aromatic oil having a boiling point range of 200°-350° C. The use of a Heavy Oil containing a large proportion of lighter fraction with boiling points below 200° C. is not advantageous, because of the high vapor pressure occurring in the tubular heater during heat treatment which requires a higher pressure for the treatment.

The process of the present invention is now illustrated in detail. The first step comprises heat treatment of the aforementioned Refined Heavy Component, i.e., the Heavy Oil which contains essentially no materials insoluble in a monocyclic aromatic hydrocarbon solvent or the Heavy Oil from which the materials insoluble in a monocyclic aromatic hydrocarbon solvent have already been removed essentially, in a tubular heater to produce 3-30 wt. % of xylene-insoluble (hereinafter occasionally referred to "XI") components without forming an appreciable amount of quinoline insoluble materials in the heat-treated material. This first step heat treatment is carried out under an increased pressure at a temperature of 400°-600° C. Specifically, it is desirable that the temperature and pressure at the outlet of the tubular heater be respectively 400°-600° C. and 1-100 $Kg/cm^2G$, and preferably 450°-550° C. and 2-50 $Kg/cm^2G$.

When conducting this heat treatment, it is preferable to exist an aromatic oil in the Refined Heavy Component to be treated. Such aromatic oil has a boiling range of 200°-350° C., and should not materially produce BTX-insoluble materials in conditions of the heat treatment in the tubular heater. The aromatic oil referred herein may be, for example, a fraction obtainable by the distillation of the raw Heavy Oil and having a boiling range of 200°-350° C. The examples are wash oil (This fraction may also be called "absorption oil".) and the anthracene oil which are the 240°-280° C. fraction and the 280°-350° C. fraction, respectively of coal tars, and the fraction with corresponding boiling range obtainable from heavy oils of petroleum origin. These aromatic oils help to avoid excessive thermal polymerization in the tubular heater, provide an adequate residence time so that the Refined Heavy Component may be thermally decomposed sufficiently, and further prevent coke clogging of the tubes. Accordingly, the aromatic oils must not thermally polymerize itself in a tubular heater to such an extent that their co-existence may accelerate the clogging of the tubes. Those containing high boiling fractions in a large amount, therefore, are not usable as the aromatic oils specified above. On the other hand, those containing a large amount of lighter fractions, e.g. boiling below 200° C., are not favorable, because a higher pressure is required to keep them in liquid state in the tubular heater. To exist an aromatic oil in a Refined Heavy Component, it is possible to select two ways. One way is that the Refined Heavy Component is prepared under a condition which to allow Refined Heavy Component will naturally contain necessary amount of the aromatic oil. The other way is that the necessary amount of the aromatic oil is added to the Refined Heavy Component when or prior to the Refined Heavy Component is fed to the heat treatment conducted in a tubular heater in the first step of the process of this invention. To achieve the purpose mentioned above, it is desirable that the material to be treated in this step contains 10-70% by weight of a fraction having boiling range of within 200°-350° C., i.e., the aromatic oil. When an aromatic oil is added to a Refined Heavy Component, the quantity of the aromatic oil to be added may be less than the quantity in weight of the Refined Heavy Component to be heat-treated. When considering a view point of process economy, it is needless to say that it is better to use an aromatic oil obtained from the raw material Heavy Oil than the use of an aromatic oil obtained from other sources.

The temperature and residence time of heat treatment should be selected from ranges which produce 3-30 wt % of xylene-insoluble component in the heat-treated material and produce essentially no quinoline-insoluble component. Generally speaking, too low a temperature or too short a residence time not only decreases production of BTX-insoluble components, thus impairing the efficiency, but also produces BTX-insoluble components having too low a molecular weight, so that it becomes necessary to employ more severe heat treatment conditions for mesophase formation which is to be carried out succeeding the hydrogenation. This appears rather to cause the quinoline-insoluble content in the mesophase pitch to increase. Conversely, too high a temperature or too long a residence time results in excessive thermal polymerization, bringing about formation of a quinoline-insoluble component, as well as production of coke which may cause clogging of the tube to occur. When the temperature is in the range of 400°-600° C., a suitable residence time range is usually 10-2,000 sec, with a preferable range being 30-1,000 sec. In addition to the requirement that the BTX-insoluble component produced in the first step be essentially free from a quinoline-insoluble component, a more important factor in the determination of the heat treatment conditions in this first step is that such conditions be selected from the range which do not produce large amount of components insoluble in the hydrogen-donating solvent used in the succeeding hydrogenation treatment. The allowable amount of the hydrogen-donating solvent-insoluble components to exist, is dependent on the kind of the hydrogen-donating solvent, and thus cannot be numerically defined. It is sufficient, however, to confirm non-existence of an insoluble material precipitant in a mixed solution of the hydrogen-donating solvent and the BTX-insoluble component obtained in the first step, which is prepared by mixing the latter with a required amount of the former to dissolution and left stand still at 80°-100° C. for overnight. When a considerable amount of the insoluble material precipitant is formed, continuous operation of the hydrogenation treatment will be difficult or almost impossible due to clogging of pumps or pipes. Existence of fine insoluble materials which produce no precipitant through this procedure poses no problem, because such fine insoluble materials can be reformed into soluble materials by hydrogenation in one hand, and on the other hand, because the solvent itself releases hydrogen which assists to increase a dissolving ability of the solvent. These can, however, be controlled only when a Refined Heavy Component which is essentially free from a BTX-insoluble material is used as the raw material for the heat treatment in the first step.

As to the pressure of the heat treatment, at a too low pressure, e.g. at a pressure of below 1 $Kg/cm^2G$ at the outlet of the tubular heater, the lighter fractions of the Refined Heavy Component or aromatic oil will vaporize and liquid-gas phase separation will take place. Under this condition, excessive polymerization will occur in the liquid phase so that a larger amount of QI components are produced and coke clogging of the tubes will result. Therefore, a higher pressure is generally preferable, but a pressure of above 100 $Kg/cm^2G$ will make the investment cost of the plant unacceptably expensive. Therefore, the pressures which can keep the Refined Heavy Component to be treated and aromatic oil in a liquid phase are sufficient.

The heat treatment at this first step has a great influence on the characteristics of the ultimate products, i.e., the mesophase pitch, and of the carbon fibers produced therefrom. This heat treatment can never be carried out in a batch-type pressurized heating facility such as a commonly used autoclave. It is because a batch-type apparatus is incapable of effectively controlling the short holding time of 10-2,000 sec, and with such a batch system, one cannot help employing a lower temperature to complement a longer holding time in the order of hour or hours. But, we have experienced that the heat treatment at such conditions involves the production of a considerable amount of coke-like solid materials which are insoluble in quinoline, when the heat treatment is continued long enough to obtain a sufficient amount of BTX-insoluble components. Since the first step of the present invention requires a sufficient degree of thermal cracking reaction to take place while preventing the excessive thermal polymerization reaction, it is imperative that the heat treatment be conducted in a tubular heater under the specified conditions.

While considering the all factors mentioned above, the actual conditions for conducting the first step can be selected. A measurement to determine the fact that whether the selected conditions are appropriate or not is to determine the QI content of the product. The conditions giving a product containing more than 1 wt. % of QI component are not suitable. It shows that an excessive thermal polymerization occurred in the tubular heater and clogging of tube by coking may arise. When using the heat-treated materials obtained under such severe conditions, after the heat treatment, it is indispensable that the excessively highly polymerized materials formed must be removed from the heat-treated product in any one of operational stages. Contrary to the above, when the product contains QI component less than 1 wt. %, the removal of QI component after the heat treatment is unnecessary.

The accurate control of QI content of the product mentioned above can only be done by using a tubular heater and by the use of a Refined Heavy Component containing no or essentially no XI material.

Further, it was known that the process conditions, such as heating temperature and residence time, of the heat treatment in the tubular heater can be changed by providing a soaking drum after the tubular heater. This procedure can also be used in the process of the present invention. However, it is not preferable to select the conditions of the heat treatment in a tubular heater, if the conditions require to use a very long residence time in the soaking drum. The use of a very long residence time in the soaking drum gives similar effects as the use of a batchwise operation, such as an operation in an autoclave and gives the formation of QI component.

Accordingly, even if the soaking drum is used, the conditions of heat treatment in a tubular heater should be selected from the conditions described before. The heat-treated material subjected a heat treatment within a tubular heater in the first step of the process of this invention can directly be fed to the second step of this invention by merely removing cracked gases formed by the heat treatment or can be fed to the second step after removing cracked gases and a part of light fractions both formed within the heat treatment, by a distillation or flash distillation. When considering the separation of BTX solvent used in the second step mentioned hereunder to ease, however, it is, at least, desirable that the heat-treated material is fed to the second step after the removable of light fractions which boil below the boiling point of BTX solvent.

The distillation or flash distillation of the heat-treated material obtained in the first step may be conducted under a pressure of 0–3 Kg/cm$^2$A and at a temperature of 200°–350° C. When an aromatic oil is co-existed or used in the heat treatment within a tubular heater as mentioned above, the aromatic oil may be separated and removed concurrently in the distillation or flash distillation step.

The conditions of distillation or flashing in this first step are established such that the thermal-cracked heavy component to be produced contains 10–70 wt. %, preferably 20–60 wt. %, of light fraction having the boiling point range of 200°–350° C. (converted into the atmospheric pressure), and has a viscosity at 100° C. of below 1,000 cSt.

This first step may include the operation for separating the distilled or flashed light fraction with boiling points below 350° C. into fractions having a boiling point range of 200°–350° C. and those with boiling point of lower than 200° C. The fractions having the boiling point range of 200°–350° C. may be used as is as the diluent, when the process employs an aromatic oil as a diluent in a tubular heater in the first step.

The second step comprises addition of the BTX solvent to the heat-treated material obtained in the first step or thermal-cracked heavy components obtainable by removing a part of light fractions from the heat-treated material to separate and recover the BTX-insoluble components newly formed. It is desirable that the heat-treated material or thermal-cracked heavy component to which the BTX solvent is added in this step is a liquid having a good fluidity at a temperature below the boiling point of the BTX solvent used. If the heat-treated material or thermal-cracked heavy component is solid or very viscous at or higher than the boiling point of the solvent, a special facility such as a pressurized heating dissolver is required for mixing and dissolving such solid or viscous material with the BTX solvent. In addition to the above, when trying to mix around room temperature, it takes a long time for mixing and dissolving, thereby making the process uneconomical. When dissolving a high softening point pitch into BTX solvent, it is generally accepted in laboratory scale experiments that pitch is finely pulverized prior to dissolving it in the solvent. This method is, however, hardly difficult to adopt in an industrial scale production, because pitch is an adhesive material and when it is intended to pulverize a pitch, pitch powders themselves stick each other to form agglomerated materials due to the heat generated and the force exerted in the pulverization operation.

When the heat-treated material or thermal-cracked heavy component is a liquid which is fluid enough at the temperature below the boiling point of the solvent, mixing and dissolving the heat-treated material or thermal-cracked heavy component and the BTX solvent is sufficiently performed by merely maintaining the heat-treated material or thermal-cracked heavy component at about 100° C. and charging the BTX solvent to the pipe in which the thermal-cracked heavy component flows. Alternatively, a simply facility such as a dissolving vessel may be installed as required. The heat-treated material or thermal-cracked heavy component thus obtained according to the manner which satisfies the above-mentioned conditions required in the first step, usually has a sufficient fluidity at below the boiling point of the solvent.

Treatment using a solvent in the second step, therefore, may be performed under the conditions at a temperature ranging from normal temperature up to the boiling point of the solvent used and at which said heat-treated material or thermal-cracked heavy component is fluid enough, a pressure ranging from normal to 2 Kg/cm$^2$G, and while stirring for a period of time sufficient for the soluble components to dissolve. It is also possible to heat only said heat-treated material or thermal-cracked heavy component in advance, subsequently adding the solvent which is kept at approximately normal temperature.

A suitable amount of the BTX solvent used in the second step is 1–5 times by weight of the heat-treated material or thermal-cracked heavy component. The same reasons as those applied to the raw material refining mentioned previously are applicable to the amount of the solvent to be used here. That is, the lower and upper limits are defined because of the efficiency of the insoluble component separation and the production economy, respectively. When the amount of the solvent used in the second step is changed, the amount of insoluble materials separated from the mixed solution of the heat-treated material to thermal-cracked heavy component and the solvent is not necessarily constant. That is, when the amount of the solvent is small, the amount of the insoluble materials separated becomes small and the materials having relatively high molecular weight only are separated as the insoluble materials.

If a solvent having a dissolving ability which is significantly poorer than BTX solvents is used in this second step, the resulting insoluble components may contain a significant amount of low-molecular weight components which cannot be converted into mesophase with ease, thus making it difficult to obtain a homogeneous mesophase pitch. Conversely, the use of a solvent with a dissolving ability which is much higher than BTX solvent, results not only in decrease in the yield of the insoluble component obtained, but also in inclusion of high-molecular weight components in the soluble components. This type of soluble component, if circulated to the first step for heat treatment as stated hereunder, will give rise to formation of undesirable components such as a quinoline-insoluble component.

Separation and recovery of the insoluble components can be carried out using any suitable method, including sedimentation, liquid cyclone, centrifugation, filtration, and the like, with a preferable method of separation being that by which continuous operation is possible. The separated and recovered insoluble components may optionally and repeatedly be washed with a BTX solvent. Although a target mesophase pitch can be obtained by the process of the present invention without employing a washing step, less than two times of washing is preferable in order to elminate as much components as possible which can only be converted into mesophase in a slow rate. The separation and recovery of the insoluble components may desirably be carried out at a temperature below the boiling point of the solvent used. Usually, a temperature near normal temperature brings about a sufficient result. There is no specific restriction to the combination of the solvent used in this second step and that used in the raw material refining. The use of the same solvent is, however, preferable in view of process economy.

The insoluble component obtained in the second step, i.e., a high-molecular weight bituminous material, usually contains a quinoline-insoluble component below 1 wt. %, and a xylene-insoluble component above 40 wt. %, preferably above 50 wt. %, and is optically isotropic. A part of BTX-solvent-soluble component may be present in this high-molecular weight bituminous material. Even in the case the material to be treated in the second step is a thermal-cracked heavy component which is obtained from the first step by distilling or flashing the heat-treated material at a temperature of 200°-350° C., the materials soluble in BTX solvent contained in the thermal-cracked heavy component, are relatively low boiling point materials having boiling points corresponding to the conditions used in the distillation of flash distillation operation. Therefore, most part of such components can easily be removed by means of vacuum distillation, thermal treatment, or the like. If a BTX-solvent-insoluble component is obtained from a high-softening point pitch prepared by the distillation of the heat-treated Heavy Oil at a temperature above 350° C. which is higher than the range defined in the first step as mentioned previously, all the soluble components remaining due to insufficient washing are high-boiling point materials which have not been removed by distillation at the high temperature. Thus, distillation or flashing at such a high temperature is not economical, since eliminating these soluble components in succeeding treatments by evaporation or distillation is not easy and requires a thorough washing.

When the high-molecular weight bituminous material obtained in this second step is thoroughly washed until its content of xylene-insoluble component becomes almost 100%, it is impossible to measure its softening point by Mettler method because its softening point will be more than 350° C. The softening point will be approximately 150°-300° C. when the xylene-insoluble content is 60-80 wt. %. These high-molecular weight bituminous materials still exhibit optically isotropic structure, and do not provide a spinning pitch for manufacturing high-performance carbon fibers showing the optical anisotropy, even when heated for short periods to melt at a temperature of less than 400° C. and cooled.

The next third step is a step in which the high-molecular weight bituminous material, i.e., insoluble component separated and recovered in the second step, is heat-treated with a hydrogen-donating solvent so as to hydrogenate the high-molecular weight bituminous material. It is necessary to hydrogenate this high-molecular weight bituminous material obtained in the second step by heat treatment in the presence of a hydrogen-donating solvent, since this material is difficult to be catalytically hydrogenated with hydrogen gas under an increased pressure. Also, when the high-molecular weight bituminous material obtained in the second step contains BTX solvent used in the second step, it is desirable to eliminate it. Such elimination can be effected by any means, including a simple evaporation with heating or distillation under a reduced or normal pressure. There is no specific limitation to the timing of the elimination. It may be performed before mixing the high-molecular weight bituminous material with a hydrogen-donating solvent. Alternatively, a paste-like insoluble component, having the BTX solvent being contained therein, is first mixed with the hydrogen-donating solvent, and then the BTX solvent is selectively eliminated from the mixture.

The hydrogenation of the high-molecular weight bituminous material such as pitches by the use of a hydrogen-donating solvent may be conducted in any suitable manner such as those disclosed in Japanese Patent Laid-opens Nos. Sho 58(1983)-196292, Sho 58(1983)-214531 and Sho 58(1983)-18421. Since the use of a catalyst necessitates a catalyst separation process, it is preferable in view of the process economy to conduct the hydrogenation reaction without catalyst. The hydrogen-donating solvents usable for the reaction include tetrahydroquinoline, tetralin, dihydronaphthalene, dihydroanthracene, hydrogenated wash oils, hydrogenated anthracene oils, and partially hydrogenated light fractions of naphtha tars, pyrolysis tars, decant oils, and the like. As stated above, when selecting a hydrogen-donating solvent to be used, it is necessary to consider the dissolving ability of the hydrogen-donating solvent against the high-molecular weight bituminuous material obtained in the second step, carefully. From the view-point of the ability to dissolve the high-molecular weight bituminous materials, tetrahydroquinoline, hydrogenated wash oils, and hydrogenated anthracene oils are preferable.

Hydrogenation may be carried out in a batch-type system, using apparatus such as an autoclave, under pressure naturally occuring in the reaction. Use of a batch-type system, however, involves difficulty in controlling the temperature as the apparatus becomes larger, and at the same time, tends to enlarge the temperature difference between the outer side and center of an apparatus, thus causing formation of coke-like solid materials during hydrogenation treatment. Since it is not easy to remove these solid materials by means of filtration, or the like after completion of hydrogenation, use of the process free from solid material formation during hydrogenation is recommended. One of the desirable processes is to continuously hydrogenate the high-molecular weight bituminous material in the presence of 1-5 times by weight of a hyrogen-donating solvent in a tubular heater at a temperature of 350°-500° C., preferably 400°-460° C. and pressure of 20-Kg/cm$^2$G. This process of hydrogenation not only ensures the efficiency by virtue of its continuous operation, but also makes it possible to hydrogenate the high-molecular weight bituminous material without formation of coke-like solid material. A desirable amount of the solvent used is 1-5 times by weight of the high-molecular weight bituminous material, as mentioned just above, since the hydrogenation can be performed effectively and economically enough with this amount of the solvent. The residence time may usually be in a 10-120 min range at a temperature of 400°-460° C.

The next fourth step is a step in which a part or almost all of the hydrogen-donating solvent and light fractions is removed from the hydro-treated mixture obtained in the third step so as to obtain an essentially optically isotropic hydrogenated pitch.

This fourth step can be conducted by any arbitrary means such as distillation or the like. This can be performed by a conventional distillation unit of either batch-or continuous-type. However, since the high-molecular weight bituminous material continuously obtained in the second step of the process of the present invention contains a relatively low-boiling point fraction which is soluble in a BTX solvent, it is desirable to subject the hydro-treated mixture to continuous flash distillation under a pressure of 0-3 Kg/cm$^2$A and temperature of 300°-530° C. By doing so, the solvent, low-boiling point fraction contained in the high-molecular weight bituminous material, and light fraction formed during the hydrogenation treatment can be simultaneously separated and removed, and recovering a hydrogenated pitch from the bottom of the flashing column. An essentially optically isotropic hydrogenated pitch having a softening point (JIS Ring and Ball method) of 100°-200° C, and containing a quinoline-insoluble component below wt. % and xylene-insoluble component above 40 wt. % can be continuously produced according to this process. When other type of process is employed to conduct the solvent removal, it is desirable to perform the process so as to obtain a hydrogenated pitch having the aforementioned properties. It is preferable to maintain quinoline-insoluble content as low as possible. As to the xylene-insoluble component, too small amount of this component requires very severe heat treatment conditions at the next fifth step to obtain a mesophase content of more than 90%, so that the treatment involves formation of a large amount of the quinoline-insoluble component. Submitting the material containing a large amount of a residual solvent or light fraction to the next heat treatment makes the volume to be treated larger, and thus is not desirable. The softening point (JIS Ring and Ball method) range of a hydrogenated pitch which satisfies these conditions is between 100° C. and 200° C.

The next fifth step is a step in which the hydrogenated pitch obtained in the fourth step is heat-treated to convert it into a substantially optically anisotroic pitch thereby obtaining a raw material pitch for the production of high-performance carbon fibers. The heat treatment of the hydrogenated pitch obtained in the fourth step can be conducted by conventional processes, for example, the treatment can be carried out under a reduced pressure or normal pressure while blowing an inert gas or a super-heated vapor at a temperature of 350°-500° C. for 10-300 min, with preferable ranges being 380°-480° C. and 10-180 min. This heat treatment may be conducted in a batchwise operation, such as by using an autoclave. The hydrogenated pitch may also be continuously heat-treated using a thin-film evaporator or flow-down film type heat treatment apparatus under a reduced or normal pressure while passing an inert gas or super-heated vapor at a temperature of 350°-500° C. As the inert gases and super-heated vapors used in this step, inert gases such as nitrogen, helium, argon, and the like and high temperature super-heated vapors which are inert at the treating temperature, obtainable by heating of water, low-boiling point organic compounds or low-boiling point oils can be cited. Hereinafter these inert gases and super-heated vapors are occasionally referred to "Inert Gas(es)".

During this heat treatment, the hydrogenated bituminous material, i.e., hydrogenated pitch, which is essentially isotropic can be transformed into a mesophase pitch having mesophase content of over 90%, and usually showing anisotropy in its entirety or near entirety.

In summary, when using the high-molecular weight bituminous material obtained in the second step of the process of the present invention, the bituminous material can be readily transformed into entirely or almost entirely anisotropic mesophase pitch, since the material is prepared by a specific procedure and under specific conditions, and is thus composed of stringently selected components. In general, the optically anisotropic pitch obtainable by the fifth step of the process of this invention has following properties: Mettler method softening point of below 310° C., quinoline insoluble content of less than 10 wt. %, xylene insoluble content of higher than 90 wt. % and content of the optically anisotropic portion of higher than 90%. The process of the present invention can provide a spinning pitch having especially high homogenuity and having the following four required characteristics which have never been satisfied by any one of pitches prepared by known conventional processes; that is, (1) a low-softening point, (2) a high mesophase content, (3) a low content of quinoline-insoluble components, and (4) a low content of xylene-soluble components. Accordingly, the optically anisotropic pitch obtained by the process of this invention is especially suitable as the raw material pitch for the production of ultra high-performance carbon fibers.

If desired, the fourth step and the fifth step mentioned above, that is, removal of the solvent and light fractions from the hydro-treated mixture obtained in the third step and conversion of the hydrogenated pitch thus obtained into an optically anisotropic pitch by a heat treatment, can be conducted in an integral processing zone, in other words, can be conducted as a combined step, by the use of, for example, following means.

We have already invented a continuous process for preparing a high-softening point pitch which comprises heat treating a heavy oil or pitch by dispersing said heavy oil or pitch in a gas stream of an inert gas or super-heated vapor as fine oil droplets thereby bringing the dispersed fine oil droplets into contact with the inert gas or super-heated vapor, at 350°-500° C. under a reduced or normal pressure (Japanese Patent Laid-open No. Sho 63(1988)-317589. In the followings, this process is simply referred to "continuous dispersion-heat-treatment process". According to the continuous dispersion-heat-treatment process, a raw material to be heat-treated, i.e., a hydro-treated mixture or a hydrogenated pitch when preparing a mesophase pitch for producing HP carbon fibers, and a soluble pitch, soluble component or a solvent solution of soluble component when preparing an isotropic pitch for producing GP carbon fibers, is continuously fed into a treating zone kept at 350°-500° C. under a reduced or normal pressure in which the raw material is dispersed as fine oil droplets by suitable means provided within the treating zone. As preferred means, a means comprising dropping Heavy Oils onto a rotating disk-type structure and purging them in the direction substantially perpendicular to the rotating axis of the disk by means of the centrifugal force of the rotating disk-type structure, means which utilizes the pressure of a pump or the like such as used in a fuel oil burner, or that which utilizes the negative pressure which is generated by a high-speed fluid produced by a device such as an ejector can be cited. The dispersed fine oil droplets naturally come into contact with Inert Gas fed into the zone. The light fractions contained in the raw material are transferred to vapor phase and vented together with Inert Gas from the upper part of the zone, and heavier fractions contained in the raw material are subjected to heat treatment during the course of dispersion as fine oil droplets and collection by collecting pan or pans within the zone and then recovered from the lower part of the zone. In the treating zone, dispersion and collection of liquid raw material or heavier component thereof can be treated repeatedly, if necessary.

A preferred embodiment of the apparatus used in the present invention will now be illustrated referring to the drawing. In FIG. 1, 1 means a rotating disk, 2 means an inverted frustconical collecting pan, and 3 means the rotating axis. Numeral 4 means the nozzle for feeding preheated raw material, e.g. hydro-treated mixture, hydrogenated pitch, soluble component, solvent solution of soluble component, soluble pitch or Refined Heavy Component (hereinafter simply referred to "heavy oil" for simplifying the explanation of the continuous dispersion-heat-treatment), 5 means the nozzle for feeding preheated Inert Gases, 6 means the nozzle for discharging the product pitch, 7 means the venting nozzle for spent gas and vaporized light fractions, 8 means a motor for rotating the rotating disk, 9 means a flange for fixing the collecting pan, and 10 means the vessel of the apparatus. The apparatus shown in FIG. 1 is designed such that disks 1 are fixed at the rotating axis 3 by means of bolts, and the collecting pans 2 are fixed by means of flanges 9. This arrangement makes it possible to change the number of stages of the disk-collecting pan combination and their relative locations.

Preheated heavy oil is charged from nozzle 4 into the apparatus of FIG. 1. The uppermost part of the vessel 10 constitutes a flash zone so that a certain amount of light fractions may be removed here and discharged through nozzle 7. The pitch produced here is collected by the uppermost collecting pan 2 and drops down from there onto the second disk 1. The pitch thus dropped onto the second disk 1 is dispersed as oil droplets in the direction substantially perpendicular to the rotation axis 3 of the disk by its centrifugal force. The oil droplets come into contact with the preheat Inert Gas which is charged from the nozzle 5 at the bottom, thereby the light fractions being eliminated therefrom. The pitch thus produced is collected by the second collecting pan 2 and drops down onto the third disk 1, where it is again dispersed as oil droplets. This dispersion and collection sequences are repeated as the pitch travels down the vessel 10, while light fractions are removed therefrom and a moderate degree of thermal polymerization is effected. The pitch is finally discharged from the vessel 10 by pump, or the like through nozzle 6 at the bottom of the vessel 10.

In the apparatus having the construction shown in FIG. 1, the direction of the movement of the discharged oil droplets and the flow of Inert Gas are substantially perpendicular to each other, and the flows of the pitch and Inert Gas in the vessel are countercurrent with each other because the nozzles for feeding the raw heavy oil and Inert Gas are installed on opposite sides of the vessel. In this way, better efficiency can be achieved, because the arrangement makes possible the pitches with increasing advanced treatment to come into contact with the fresh Inert Gas. If desired, the Inert Gas can be fed to each of the stages.

According to this type of continuous dispersion-heat-treatment, the aforementioned fourth and fifth steps of the present invention can be performed in a single treating zone. Specifically, according to this continuous dispersion-heat-treatment method the hydro-treated mixture produced in the third step is dispersed in the form of fine oil droplets in this treating zone and is caused to come contact with an inert gas stream or a super-heated vapor stream under reduced or atmospheric pressure at 350°–500° C., and, if required, the dispersion-agglomeration cycle of the liquid component is repeated several times under these treatment conditions. This treatment removes the solvent and light fraction which vaporize under the treatment conditions leaving the liquid phase heavy component (hydrogenated pitch component). At the same time, this liquid phase heavy component is rendered to become even heavier through the heat treatment, thus yielding an optically anistropic pitch, which is drawn from the treatment zone. The treatment temperature is usually 350°–500° C. as mentioned above, but preferably is 380°–480° C. The treatment time (residence time) in this continuous dispersion-heat treatment method can be significantly shorter than in conventional heat treatment method, although it depends upon other factors such as the type of the equipment structure used, the treatment temperature, etc. This shortened treatment time suppresses the formation of undesirable high-molecular weight components such as quinoline insoluble component, thereby producing an extremely uniform pitch. The treatment time (residence time) is usually 15 minutes or shorter when the equipment having the structure shown in FIG. 1 is used. As examples of the inert gas, nitrogen, helium, argon, and the like can be cited, and as examples of the super-heated vapor, a super-heated vapor which is inert at the treating temperature, obtainable by heating of water, a low-boiling point organic compound, and a low-boiling point oil can be cited. The amount of the inert gas or a super-heated vapor to be used is selected from the range of 0.1–10 $m^3$, preferably from the range of 0.3–3.0 $m^3$, under the treating conditions, per 1 kg of the hydro-treated mixture to be treated.

The quality of the optically anisotropic pitch produced by the above continuous dispersion-heat-treatment method is equal with or superior to the optically anisotropic pitch produced via the aforementioned fourth and fifth steps. This pitch is suitable as a raw material for the manufacture of high-performance carbon fibers, especially for the manufacture of ultra high-performance carbon fibers. Therefore, the use of the continuous dispersion-heat-treatment method for the production of spinning pitches for carbon fibers is desirable in that it ensures the integration of the fourth and fifth steps, thus contributing to the simplification of the pitch production process. It is needless to say that such a continuous dispersion-heat-treatment method is applicable not only for the integration of the fourth and fifth steps, but also as a means for the fifth step's heat treatment of the hydrogenated pitch produced in the fourth step, when the fourth and fifth steps are carried out separately and consecutively according to the manner previously described.

Turning the discussion to the details of the sixth step, this step comprises producing a soluble component from the solvent solution of the soluble component which is separated in the second step by removing the solvent therefrom.

This sixth step can be performed according to a conventional distillation operation. If required, not only the solvent but also surplus light fractions contained in the soluble component may be removed. Taking into account the procedure of recycling a portion of the soluble component to the first step for reuse as a heat treatment raw material, as will be discussed later, it is desirable that the distillation conditions are determined such that the produced soluble component have the same properties as the desirable properties required for the raw material Refined Heavy Component to be fed to the first step, i.e., such properties be such that the light fraction content having the boiling point range of 200°–350° C.: 10–70% by weight and preferably 20–60% by weight, and the viscosity at 100° C.: 1,000 cSt or less. When the heat-treated material produced in the first step is submitted, as previously discussed, to the distillation or flash distillation to remove a portion of the light fraction therefrom and then fed to the second step, if suitable conditions of the distillation or flash distillation is selected, simply removing the solvent in the sixth step can produce the soluble component having properties suitable for use as a heat treatment feedstock for the first step. When the easiness in the solvent recovery and the like are to be considered, it is desirable to feed the heat-treated material produced in the first step to the second step after submitting it to the distillation or flash distillation under suitably selected conditions, and to employ the distillation operation in this sixth step for the limited purpose of the solvent separation and recovery.

The soluble component thus produced is used as the raw material for producing a pitch for GP carbon fibers. In this case, if required, it is possible to use a portion of the produced soluble component as the raw material for GP carbon fibers and to recycle the remaining soluble component to the first step for use as the heat treatment raw material. It is also possible to use a portion of the produced soluble component as the raw material for GP carbon fibers, to recycle another portion to the first step for use as the heat treatment raw material, and to discharge the remaining portion of the soluble component from the process as a by-product. Of course, it is possible to use a portion of the produced soluble component as the raw material for GP carbon fibers and to discharge all the remaining portion from the process as a by-product.

When a portion of the soluble component produced in the sixth step is recycled to the first step as the heat treatment raw material, this soluble component is heat-treated in a tubular heater in the same way as the Refined Heavy Component which is the fresh raw material for the first step, and again produce xylene insoluble component. This contributes to the increase in the insoluble component in proportion to the soluble component recycled to the first step, and consequently to the increase of the optically anisotropic pitch for the manufacture of high-performance carbon fibers. In this manner, depending on the requirement, it is possible to control the ration of the optically anisotropic pitch to be directed to the manufacture of high-performance carbon fibers and the pitch to be used for the manufacture of GP carbon fibers by controlling the amount to be used as the raw material for GP carbon fibers, the amount to be recycled to the first step, and the amount to be discharged from the process. This is one of the outstanding features of the present invention.

The concept of recycling the soluble component produced in the sixth step for use as a heat treatment raw material for a step such as the first step of this invention to increase the yield of the pitch for the manufacture of high-performance carbon fibers was already proposed by us (Japanese Patent Laid-open No. Hei 1(1989)-129092. The recycling of the soluble component produced in the sixth step of the first step can be suitably performed according to the process disclosed in the Japanese patent laid-open mentioned just above.

The next seventh step comprises submitting the soluble component produced in the sixth step to the distillation or flash distillation to remove light fractions and to produce a soluble pitch. Conventional distillation or flash distillation procedures can be applied to this seventh step. The component produced in the sixth step contains light fraction having a boiling point range of 200°-350° C. as mentioned above. It is desirable to remove the light fractions in order to improve the heat treatment efficiency in the subsequent eighth step if a batch-type equipment is employed in the eighth step, since such removal of the light fractions will increase the yield per batch in the eighth step. Since the object of the distillation or flash distillation in the seventh step is to remove light fraction in the soluble component produced in the sixth step, the conditions involving heat decomposition or thermal polymerization should not be employed. Usually, the temperature for the distillation or flash distillation in this seventh step is 400° C. or lower, and preferably 350° C. or lower. Either reduced or atmospheric pressure is applied. It is possible to omit the seventh step, when the content of the light fraction in the soluble componet produced in the sixth step is low. There are no specific limitations as to the properties of the soluble pitch which is produced in the seventh step. From the aspect of the handling easiness, the use of distillation conditions which would produce a soluble pitch having a softening point (JIS Ring and Ball method) of 200° C. or higher is undesirable. Usually, quinoline insoluble components are hardly detected in the soluble pitch.

The eighth step comprises heat treatment of the soluble pitch produced in the seventh step or the soluble component produced in the sixth step when the seventh step is omitted, and convert them into a pitch for the manufacture of GP carbon fibers. In general, this pitch for the manufacture of GP carbon fibers should be completely optically isotropic when observed on a polarizing microscope. Desirable pitches of this type are those containing essentially no optically anisotropic portions, which are observed in pitches for the manufacture of high-performance carbon fibers, nor quinoline-insoluble components.

Almost the same conditions as those applied to the fifth step heat treatment are applicable to the heat treatment of this eighth step. Conventionally known conditions can be used; i.e., a heat treatment under a reduced or normal pressure while blowing an inert gas or a super-heated vapor, at 350°-500° C. for 10-300 minutes, in general, and preferably at 380°-480° C. for 10-180 minutes. The heat treatment is carried out, for example, by a batch process using an autoclave, or ay a continuous process using a thinfilm evaporator, a flow-down film-type heat treatment apparatus, etc., or by means of the above-mentioned continuous dispersion-heat-treatment method, under a reduced or atmospheric pressure in the stream of an inert gas or a super-heated vapor at 350°-500° C.

As examples of an inert gas, nitrogen, helium, argon, and the like can be cited, and as examples of a super-heated vapor, a super-heated vapor which is inert at the treatment temperature obtainable by heating of water (i.e., super-heated steam), a low-boiling point organic compound, a low boiling point oil, and the like can be cited.

Through the heat treatment in this eight step the soluble pitch which is produced in the preceding seventh step is rendered heavier to become isotropic pitch which is suitable for the manufacture of GP carbon fibers. Precaution which should be taken in relation to the eighth step heat treatment is that the operating conditions to be adopted should not be those producing high-molecular weight components such as quinoline-insoluble components or solid components such as coke. Pitches containing such high-molecular weight components or solid components will cause the problem of blocking spinning nozzles when they are melt and spun into fibers. If too mild heat treatment conditions are used so as not to produce these undesirable components, however, the pitches produced will have a too low softening point and the light fractions will be eliminated only insufficiently from the pitches. These causes the problem of a large amount of gas generaton during spinning, and makes it difficult to render the pitches infusible by heating under an oxidizing atmosphere. A sufficient high-softening point is therefore required for pitches even though they are to be directed for the manufacture of GP carbon fibers. In general, a required softening point determined by the Mettler method is 200°-300°C., and preferably 220°-280° C. Simply heat-treating commercially available binder pitches or the like in order to obtain these types of high-softening point pitches will easily produce quinoline-insoluble components and coke-like solid components, thus making it impossible to produce pitches which can be used even for the manufacture of GP carbon fibers. However, since, as discussed above, the soluble pitches to be subjected for the heat treatment in the eighth step of this invention are those sustained the heat treatment of the first step under specific conditions and from which insoluble components, which produces when a specific amount of BTX solvents are added, are removed in the second step, they hardly produce quinoline-insoluble components and coke-like solid components, and therefore, undesirable light fractions can be sufficiently removed, thus making it possible to easily produce pitches having characteristics required for pitches directed to the manufacture of GP carbon fibers.

The above-mentioned removal of the light fractions from the soluble components by distillation or flash distillation in the seventh step and the heat treatment of the soluble pitch in the eighth step can be carried out, if necessary, in the same way as the above-mentioned single step integrating the fourth and fifth steps, in an integrated single treatment zone, for example, by the continuous dispersion-heat-treatment method which was previously discussed. That is, the soluble components produced in the sixth step is dispersed as fine oil droplets under a reduced or atmospheric pressure at 350°-500° C. in the treating zone and caused to come contact with an inert gas or a super-heated vapor, and, if required, the dispersion-agglomeration cycle of the liquid component is repeated under these treatment conditions. This treatment removes the light fractions and discharges them from the treatment zone by vaporization. It also makes the liquid components (soluble pitch components) heavier by the heat treatment thus converting it into optically isotropic pitch suitable for the manufacture of GP carbon fibers, which is drawn from the bottom of the treatment zone. Such an integration of the seventh and eighth steps into a single step is desirable in view of simplicity of the pitch manufacturing process.

Furthermore, if required, the above three steps, i.e., the sixth, seventh, and eight steps, can be integrated into a single step and carried out in a single treatment zone by means of, for example, the above continuous dispersion-heat-treatment method. That is, in the same way as the above-mentioned single step integrating the seventh and eighth steps, the solvent solution of the soluble components produced in the second step is dispersed as fine oil droplets under a reduced or atmospheric pressure at 350°-500° C. in the treating zone and caused to come contact with an inert gas or a super-heated vapor, and, if required, the dispersion-agglomeration cycle of the liquid component is repeated under these treatment conditions. This treatment removes the solvent and the light fractions by vaporization and discharges them from the treatment zone by vaporization. It also makes the liquid components (soluble pitch components) heavier by the heat treatment thus converting it into optically isotropic pitch suitable for the manufacture of GP carbon fibers, which is drawn from the bottom of the treatment zone. It is needless to say that a portion of the solvent solution of the soluble components produced in the second step can be recycled, without submitting it to said treatment, to the first step for the heat treatment after removal of the solvent.

The method previously discussed relating to the production of optically anisotropic pitches for the manufacture of high-performance carbon fibers by the integration of the fourth and fifth steps can be applied as is as a means for integrating the seventh and eighth steps, or the sixth, seventh, and eighth steps into a single step. The conditions for carrying out this method are selected among from the above-mentioned ranges in such a manner that the selected conditions can produce pitches having characteristics suitable for the manufacture of GP carbon fibers. Therefore, is each of the combinations, i.e., the combinations of (i) the fourth and fifth steps, (ii) the seventh and eighth steps, and (iii) the sixth, seventh, and eighth steps, is intergrated into a single step, all of the continuous dispersion-heat-treatment can be performed in a single facility. In this case a so-called block production is possible, wherein optically anisotropic pitch for the manufacture of high-performance carbon fibers can be produced some time and optically isotropic pitch for the manufacture of GP carbon fibers can be produced the other time.

The yields of the pitches for the manufacture of high-performance carbon fibers and for the manufacture of GP carbon fibers largely vary depending upon the raw material Refined Heavy Components and the conditions employed for the treatment. Taking as an example as refined coal tar from which xylene insoluble components are removed in advance, which is a typical Refined Heavy Component used in this invention, in case where all the soluble components produced in the sixth step are used as a raw material for the production of pitches for the manufacture of GP carbon fibers, without recycling to the first step, the yield of the pitches for the manufacture of high-performance carbon fibers is about 3-15% by weight, and the yield of the pitched for the manufacture of GP carbon fibers is about 10-20% by weight. Conversely, if all the soluble components produced in the sixth step is recycled to the first step for producing pitches for the manufacture of high-performance carbon fibers, the yield of the pitches for the manufacture of high-performance carbon fibers is about 10-40% by weight, with no production of the pitches for the manufacture of GP carbon fibers. When among from the total soluble components produced in the sixth steps an amount approximately 3 times by weight of fresh Refined Heavy Components is recycled to the first step and the remaining soluble components are used as a raw material for the production of pitches for the manufacture of GP carbon fibers, the yield of the pitches for the manufacture of high-performance carbon fibers is about 10-25% by weight, and the yield of the pitches for the manufacture of GP carbon fibers is about 10-20% by weight. The yield of the pitches for the manufacture of GP carbon fibers can also be controlled by discharging a portion of the soluble components from the process as a by-product.

As discussed above, according to the process of the present invention, the amounts of the pitches for the manufacture of high-performance carbon fibers and for the manufacture of GP carbon fibers to be produced can be adjusted by directly recycling a portion of the soluble components produced in the sixth step to the first step as a heat treatment feedstock, or a portion of the solvent solution of soluble components produced in the second step to the first step as a heat treatment feedstock after removal of the solvent therefrom. In addition, the following methods can be taken as the method of adjusting the amounts of these two types of pitches to be produced.

One of the methods is to charge a portion of the insoluble components produced by the extraction of the second extraction step to the seventh heat treatment step or the treatment zone integrating the seventh and eight steps and to heat-treat these insoluble components together with the soluble components produced in the sixth step, thus converting them into pitches for the manufacture of GP carbon fibers. In this case, as a matter of course, the amount of pitches for the manufacture of high-performance carbon fibers decreases in proportion of the reduced amount of insoluble components which are sent to the third hydrogenation step.

Another method is to charge a portion of the thermally cracked heavy oil produced in the first step to the seventh step or the treatment zone integrating the seventh and eighth steps and to submit it to the heat treatment together with the soluble components produced in the sixth step, thus converting them into pitches for the manufacture of GP carbon fibers. In this case, the amount of pitches for the manufacture of high-performance carbon fibers decreases in proportion to the reduced amount of thermally cracked heavy oil which can be sent to the second extraction step.

A still another method is to charge a portion of the fresh Refined Heavy Component to be fed to the first step to the seventh step or the treatment zone integrating the seventh and eighth steps for the heat treatment together with the soluble components produced in the sixth step, thus converting them into pitches for the manufacture of GP carbon fibers. In this case, the amount of pitches for the manufacture of high-performance carbon fibers which can be produced from a certain amount of fresh feedstock, i.e., the Refined Heavy Components, decreases in proportion to the reduced amount of the feedstock which is sent to the first heat-treating step. If all of this certain amount of fresh feedstock is charged to the first step and additional Refined Heavy Components is provided for feeding to the seventh step or the treatment zone integrating the seventh and eighth steps, it is possible to increase the amount of pitches for the manufacture of GP carbon fibers.

When a portion of the insoluble components produced in the second step, the thermally cracked heavy oil produced in the first step, or the fresh Refined Heavy Components to be fed to the first step are treated mixed with the soluble components produced in the sixth step, there is a tendency of the formation of quinoline insoluble components which are not desirable for the pitches for the manufacture of GP carbon fibers. However, the investigations on the softening points and the amount of quinoline insoluble components on the pitches for the manufacture of GP carbon fibers prepared according to each of the procedures revealed that, within the above-mentioned softening point range which is desirable for pitches for the manufacture of GP carbon fibers, these pitches contained essentially no quinoline insoluble components and had excellent quality.

As discussed above, the process of the present invention provides outstanding flexibility, since it can adjust the amount of pitches for the manufacture of high-performance carbon fibers and for the manufacture of GP carbon fibers at varied proportions.

Furthermore, according to the process of this invention a full and complete utilization of the feedstock can be achieved. As has been discussed, the fifth step or the treatment zone integrating the fourth and fifth steps yields pitches for the manufacture of high-performance carbon fibers together with a by-product which contains high-boiling point heavy oil. This heavy oil can be recycled to the first step directly or via the sixth step and subjected to the heat treatment in a tubular heater, thus making it even heavier and finally converted into pitches. In this way all the feedstock can be converted into target pitches without loss of the heavy components contained therein. This scheme greatly contributes to the promotion of the process economy.

Presented hereinbelow are more detailed discussions on several specific embodiments of the present invention referring to FIGS. 2–5, in which the same numbering is applied to the same type of equipment.

Figure 2:
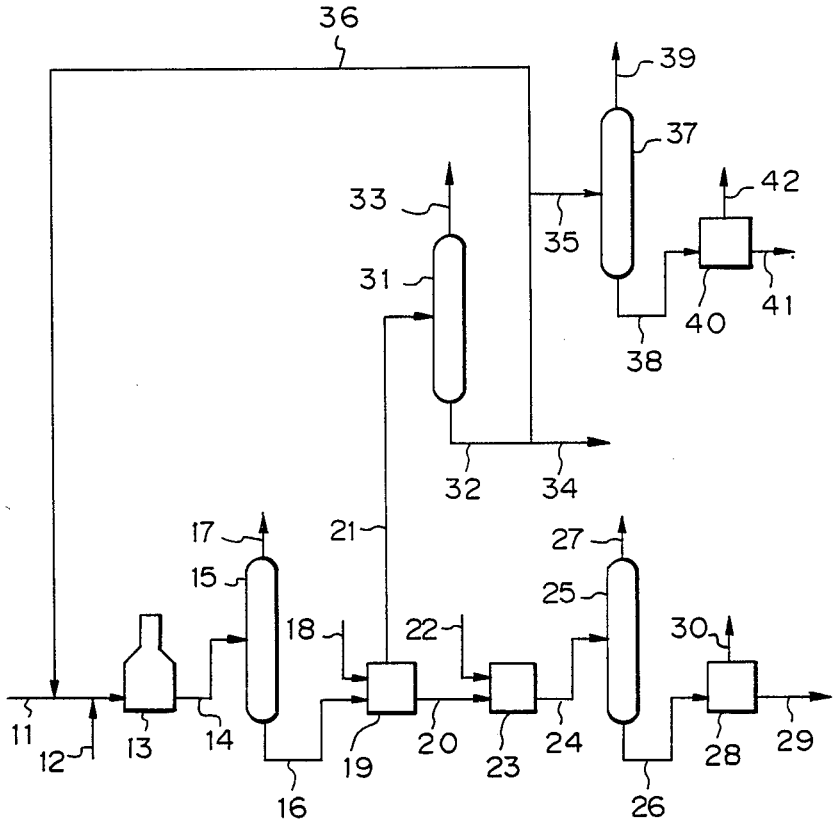
FIG. 2 is a simplified flowchart of an embodiment of the process of this invention.

FIG. 2 is a schematic drawing representing a typical embodiment for the practice of this invention. In this embodiment a Refined Heavy Component which is the feedstock of the process of this invention is fed to a tubular heater 13 of the first step via line 11. If required, an aromatic oil is added to the Refined Heavy Component via line 12. These feedstocks are heat-treated at 400°–600° C. in the tubular heater 13 and fed to a distillation column or a flash distillation column 15 via line 14. Cracked gas and a portion of light fractions separated in the distillation or flash distillation column 15 are discharged from the process via line 17, while the thermally cracked heavy oil which is collected as the bottom liquid of the distillation or flash distillation column 15 is drawn out from the column 15 via line 16, and, after having been cooled (a cooling apparatus is not shown in FIG. 2) to a temperature below the boiling point of BTX solvents, sent to a separator 19 for the separation of soluble components and insoluble components. The thermally cracked heavy oil is mixed in the separator 19 with BTX solvents which are sent there via line 18 to form insoluble components. The insoluble components are separated from the solvent solution of the soluble components and drawn out from the separator 19 via line 20, while the solvent solution of the soluble components is taken out from the separator 19 via line 21. The insoluble components which are high-molecular weight bituminous materials drawn out from the separator 19 via line 20 are fed to a hydrogenation unti 23 in the third step, where they are mixed with a hydrogen-donating solvent charged to the unit 23 via line 22 and subjected to heat treatment under specified conditions. The heat-treated material (hydro-treated mixture) is then sent via line 24 to a distillation or flash distillation column 25 in the fourth step for the production of a hydrogenated pitch. From the top of the distillation or flash distillation column 25 are drawn via line 27 a spent hydrogen-donating solvent and, if necessary, light fractions. From the bottom is taken out via line 26 the hydrogenated pitch, which is sent to a heat treatment unit 28 in the fifth step, where it is heat-treated under specific conditions to become heavier and converted into an optically anisotropic pitch. The pitch thus produced is taken out from the heat treatment unit 28 via line 29 as a target pitch for the manufacture of high-performance carbon fibers, while the light fraction is drawn out via line 30. On the other hand, the solvent solution of the soluble components which is taken out from the separator 19 via line 21 are sent to the distillation or flash distillation column 31 in the sixth step, where BTX solvents and, if necessary, a portion of the light fractions are separated and drawn out via line 33 and the soluble components are drawn out from the bottom via line 32. The soluble components are then sent to a distillation or flash distillation column 37 in the seventh step for the separation of light fractions. From the top of the column 37 via line 39 are drawn the separated light fractions and from the bottom is drawn via line 38 a soluble pitch. The pitch is sent to heat treatment unit 40 in the eighth step and is heat-treated under the specified conditions. The heat-treated pitch having a high-softening point thus produced is taken out from the heat treatment unit 40 via line 41 as a pitch for the manufacture of GP carbon fibers. At this time, as required, a portion of soluble components which is drawn via line 32 may be recycled to the tubular heater 13 in the first step via line 36. Alternatively, a portion of the soluble components may be taken out from the process as a by-product via line 34.

Figure 3:
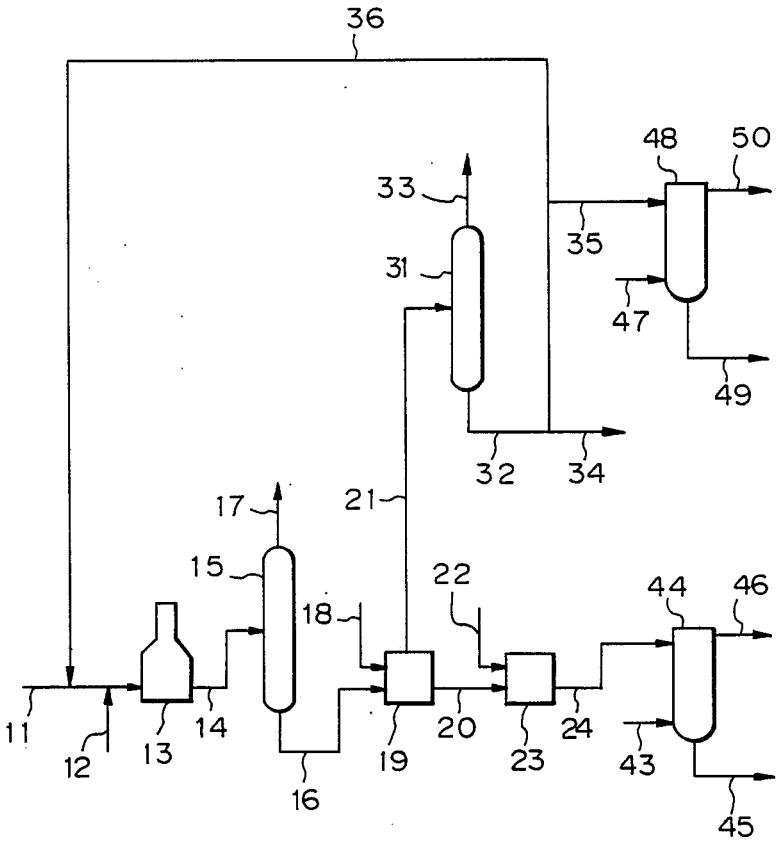
FIG. 3 is a simplified flowchart of another embodiment of the process of this invention.

FIG. 3 shows a similar schematic drawing as FIG. 2, except that the fourth and fifth steps and the seventh and eighth steps are integrated to form a single treating zone, respectively. Otherwise the process of FIG. 3 is the same as that of FIG. 2. In FIG. 3, the hydro-treated mixture drawn from the hydrogenation unit 23 is sent to a continuous dispersion-heat-treatment unit 44 via line 24. An inert gas or a super-heated vapor is supplied to the continuous dispersion-heat-treatment unit 44 via line 43, and via line 46 drawn from the unit are the spent hydrogen-donating solvent and light fractions as well as said inert gas or a super-heated vapor. Elimination of the hydrogen-donating solvent and light fractions from the hydro-treated mixture as well as the heat treatment of the hydro-treated mixture proceed in the continuous dispersion-heat-treatment unit 44, thereby yielding an optically anisotropoic pitch, which is drawn out via line 45 as the target pitch for the manufacture of high-performance carbon fibers. On the other hand, the soluble components drawn out from the bottom of the distillation or flash distillation column 31 of the sixth step are fed to the continuous dispersion-heat-treatment unit 48 via lines 32 and 35. Similar to the unit 44, via line 47 is supplied the inert gas or the super-heated vapor to the continuous dispersion-heat-treatment unit 48. The light fractions are drawn out from the continuous dispersion-heat-treatment unit 48 via line 50. In the continuous dispersion-heat-treatment unit 48, elimination of the light fractions from the soluble components as well as the heat treatment of the soluble components proceed, thereby yielding a pitch having a high-softening point, which is then drawn out via line 49 as the target pitch for the manufacture of GP carbon fibers. As in the embodiment of FIG. 2, in the embodiment of FIG. 3, a portion of soluble components which are drawn from the bottom of the distillation or flash distillation column 31 may be recycled to the tubular heater of the first step via line 36, and a portion may be taken out from the process as a by-product via line 34. Furthermore, in the embodiment shown in FIG. 3, the mixture of hydrogen-donating solvent, light fractions, and the inert gas or a super-heated vapor which is drawn from the continuous dispersion-heat-treatment unit 44 via line 46 when pitches for the manufacture of high-performance carbon fibers are produced may be treated in the following manner. That is, from the mixture drawn from said line 46 non-condensing gaseous materials are removed and the residual liquid is sent to the distillation column 15 behind the tubular heater 13 in the first step, provided that the distillation column 15 be constructed so as to draw out therefrom a side-cut fraction. In this case, said residual liquid is submitted to distillation together with the heat-treated material which is produced in the tubular heater 13. Cracked gas and light fractions are evaporated from the top, the hydrogen-donating solvent is drawn as a side-cut, and the thermal cracked heavy oil is taken out from the bottom of the distillation column 15, thereby ensuring the removal of the cracked gas and light fractions from said heat-treated material and the recovery of the hydrogen-donating solvent from said residual liquid at the same time. Workability of this type of treatment depends upon the types of raw material Refined Heavy Component and hydrogen-donating solvent used. An ideal result will be obtained, for example, when refined coal tar is used as the raw material Refined Heavy Component and hydrogenated anthracene oil is used as the hydrogen-donating solvent.

Figure 4:
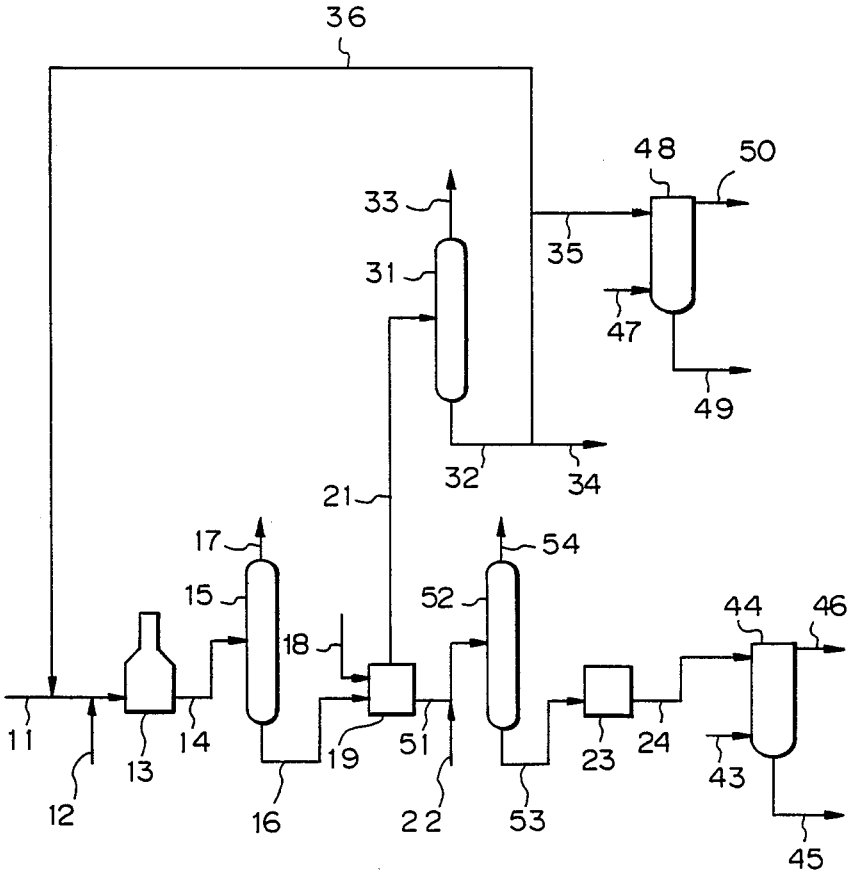
FIG. 4 is a simplified flowchart of still another embodiment of the process of this invention.

FIG. 4 is a schematic drawing of another embodiment of this invention. In this scheme, the insoluble components are collected from the separator 19 of the second step as they contain BTX solvents and drawn via line 51, and mixed with the hydrogen-donating solvent which is added via line 22. The mixture is sent to the distillation column 52, where the BTX solvents contained in the insoluble components are evaporated and separated from the top via line 54, and hydrogenation raw material is drawn from the bottom and sent to the hydrogenation unit 23 via line 53. Otherwise, this embodiment is the same as the embodiment shown in FIG. 3. The treatment for producing pitches for the manufacture of high-performance carbon fibers subsequent to the hydrogenation unit 23 is performed in the same way as the scheme in FIG. 3 using the continuous dispersion-heat-treatment unit 44. Instead of the continuous dispersion-heat-treatment unit 44, it is possible to use the combination of the distillation or flash distillation column 25 and heat treatment unit 28 of FIG. 2.

Figure 5:
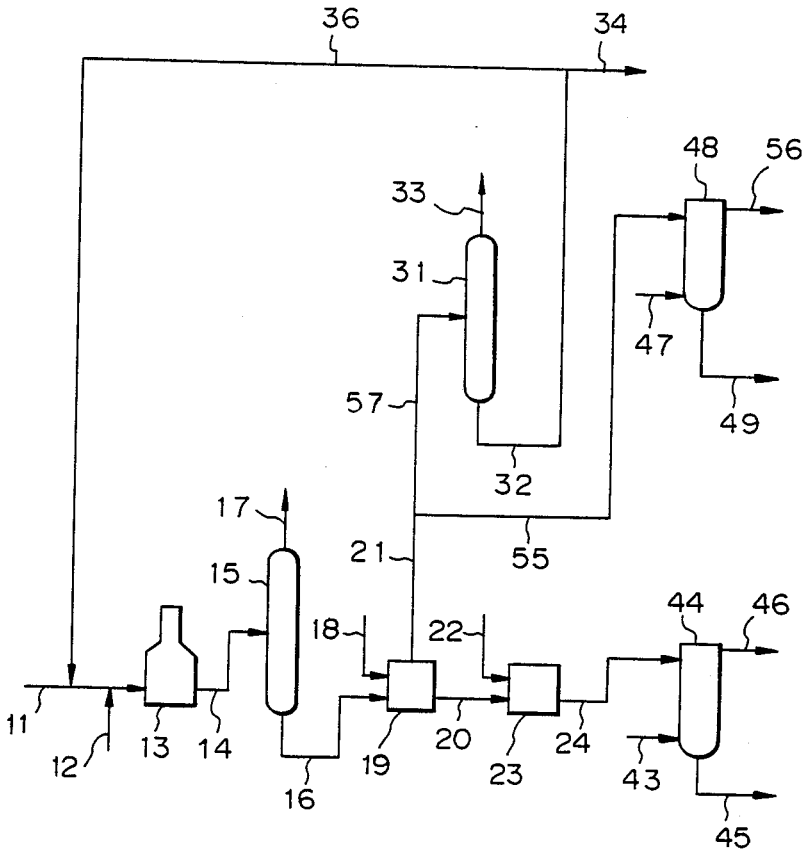
FIG. 5 is a simplified flowchart of yet another embodiment of the process of this invention.

FIG. 5 is a still another schematic drawing of the process of this invention, in which the solvent solution of the soluble components which are drawn out from the separator 19 of the second step via line 21 are sent to the continuous dispersion-heat-treatment unit 48 via line 55 for producing a pitch for the manufacture of GP carbon fibers. In this embodiment, the BTX solvents used in the second step are drawn out from the continuous dispersion-heat-treatment unit 48 via line 56 together with the light fractions contained in soluble components and the inert gas or the super-heated vapor which are fed via line 47. If required, a portion of the solvent solution of the soluble components which are drawn out from the separator 19 via lines 21 and 57 may be sent to the distillation or flash distillation column 31 for separation of BTX solvents and, if necessary, the light fractions, and the soluble components drawn out from the bottom of said column via line 32 may be recycled to the tubular heater 13 of the first step via line 36. It is needless to say that a portion of the soluble components may be discharged from the process via line 34 as a by-product.

According to the process of the present invention, pitches for the manufacture of high-performance carbon fibers, and in particular, pitches for the manufacture of ultra high-performance carbon fibers, together with pitches for the manufacture of GP carbon fibers, can be produced economically using simple procedures. Specifically, in this process for co-producing two types of pitches, the pitch for the manufacture of GP carbon fibers can be produced from the spent fraction of the raw material Refined Heavy Components which has not been used for the production of the pitch for the manufacture of high-performance carbon fibers and has been recognized as a by-product with no significant value. The process, therefore, can reduce the production cost of said two types of pitches, and thus contributes to the reduction of the production cost of high-performance carbon fibers as well as GP carbon fibers. In addition, the process of this invention can control the proportion of the pitches for the manufacture of high-performance carbon fibers and for the manufacture of GP carbon fibers in one production process. The process thus provides outstanding economy in the production of the pitches.

Incidentally, in the present invention, quantitative analysis of xylene- and quinoline-insoluble components were carried out according to the following method.

One (1) g of sample was weighed in a centrifugal precipitation tube, to which 30 cc of a solvent (xylene or quinoline) was added. The tube was dipped into a water bath maintained at 80° C., at which temperature its content was agitated for about 1 hr to dissolution. The tube was then taken out from the bath, and after being cooled to room temperature, was subjected to centrifugation at 5,000 rpm for 10 min. The supernatant in the centrifugal precipitation tube was carefully removed by a syringe. To this centrifugal precipitation tube, 30 cc of the solvent was again charged and agitated in the bath at 80° C. for 30 min to wash and disperse the precipitate. The tube was then taken out from the bath and centrifuged at room temperature, and the supernatant was removed by a syringe. The addition of 30 cc of the solvent, washing, dispersion, and centrifugation were repeated once more. The supernatant was removed from the tube and the residual insoluble component in the tube was washed away therefrom with xylene, and subjected to filtration by means of suction in a G-4 glass filter. The residue remained in the glass filter was washed twice with about 10 cc of xylene and subsequently once again with 10 cc of acetone, dried in a dryer at 110° C., and finally weighed.

DESCRIPTION OF THE PREFERRED EMBODIMENT

The present invention is hereafter described more materially by way of Examples. It is to be noted, however, that these Examples are shown for illustration only and the scope of this invention is not limited thereby. In the description of Examples below, designations of "%", "times" and "parts" mean "% by weight", "times by weight" and "parts by weight", respectively, unless otherwise specified. Optically anisotropic portion and optically isotropic portion are area fractions obtained by polarizing microscopy. Distillation temperature used herein means column-top temperature unless otherwise specified.

EXAMPLE 1

A commercially available heavy coal tar with properties shown in Table 2 was used as the raw material. The heavy coal tar was obtained from a coal tar by a pretreatment in which a portion of light fractions were removed by a distillation operation at 300° C. One (1) part of the heavy coal tar was mixed with and dissolved in 2 parts of xylene, and then insoluble components thus formed were separated and removed by a continuous filter. Xylene was removed from the filtrate by distillation and thereby obtained a refined heavy component with properties shown in Table 2. The yield of the refined heavy component was 92.1 wt. % based on the heavy coal tar.

The refined heavy component was heat-treated continuously at a charge rate of 17.5 Kg/hr at a temperature of 470°-520° C. under a pressure of 20 Kg/cm$^2$G in a tubular heater having a heating tube with internal diameter of 6 mm and length of 40 m dipped in a molten salt bath. The heater effluent was sent to a flash distillation column and was flash distilled at the overhead temperature of 250° C. under the atmospheric pressure so as to remove lighter fractions from the overhead and a thermally cracked heavy oil was recovered from the bottom of the column. Two (2) weight parts of xylene were added to 1 part of the thermally cracked heavy oil kept at about 100° C. and the thermally cracked heavy oil was dissolved in the xylene by mixing, and then the solution was cooled to room temperature. The solution containing insoluble component was treated in a continuous centrifuge (Mini-Decanter manufactured by Ishikawajima Harima Heavy Industries, Ltd.) so as to separate and recover the insoluble component. Two (2) weight parts of xylene were added to 1 part of the insoluble component thus obtained and the mixture was agitated. The mixture was filtered under pressure to separate the insoluble component from solvent solution of soluble component. The insoluble component was heated under vacuum so as to remove xylene, and thus obtained a purified insoluble component as a high-molecular weight bituminous material. Further, soluble component was obtained by distilling the solvent solution of soluble component obtained in the separating operations conducted in twice as mentioned above so as to remove xylene therefrom. Yields of each component thus obtained based on the refined heavy component and the properties of the insoluble component are shown in Table 3.

Then, 1 weight part of the high-molecular weight bituminous material (insoluble component) was dissolved in 3 weight parts of a hydrogenated anthracene oil, and the mixture was hydrogenated continuously at a charge rate of 6.5 Kg/hr by heating at a temperature of 440° C. under a pressure of 50 Kg/cm$^2$G in a tubular heater having a heating tube with internal diameter of 10 mm and length of 100 m dipped in a molten salt bath. Then, the hydrogenated mixed solution was sent to a flash distillation column and flash distilled at the overhead temperature of 400° C. under the atmospheric pressure so as to remove spent solvent and lighter fractions from the overhead thereby recovered a hydrogenated pitch from the bottom of the column.

Then, 100 g of the hydrogenated pitch was put in a polymerization flask dipped in a molten salt bath kept at 450° C. and heat treatment was conducted for 30 min under the atmospheric pressure by bubbling a nitrogen gas stream at a rate of 8 liters/min. Thus, an optically anisotropic pitch for the production of high-performance carbon fibers was obtained. The yields and properties of the hydrogenated pitch and the pitch for the production of high-performance carbon fibers are respectively shown in Table 4.

The optically anisotropic pitches obtained in Experiment Nos. 2, 3 and 4 were spun by using a spinning apparatus having a spinning nozzle hole with internal diameter of 0.25 mm and length of 0.75 mm at a spinning temperature of 340° C. and at a spinning rate of 700 m/min. The pitch fibers were rendered infusible, in air, by raising the temperature at a rate of 1° C./min until the temperature was reached to 320° C. and maintaining the fibers at 320° C. for 20 min. The fibers were carbonized at 1000° C. in a nitrogen gas atmosphere, thereby obtained carbon fibers. The characteristics of the carbon fibers are shown in Table 5.

Further, 250 g each of the soluble components obtained in Experiment No. 1, 3 and 5 were respectively put into polymerization flask dipped in a molten salt bath kept at 430° C. and heat treatment were conducted for 70 min by bubbling nitrogen gas streams at a rate of 8 liters/min under normal pressure, respectively, thereby obtained heat-treated pitches for manufacturing general purpose carbon fibers. The yields of these heat-treated pitches based on the refined heavy component and the properties of the heat-treated pitches are shown in Table 6.

The heat-treated pitches thus obtained were spun by the use of the spinning apparatus shown above at a temperature of 285° C. under a winding rate of 500 m/min. The pitch fibers thus obtained were rendered infusible and carbonized under the conditions as described before. Thus carbon fibers were obtained. The properties of the carbon fibers are shown in Table 7.

TABLE 2

| | Heavy Coal Tar | Refined Heavy Component |
|---|---|---|
| Specific gravity | 1.206 | 1.203 |
| Viscosity (cSt, 100° C.) | 74.7 | 59.4 |
| Xylene insolubles (wt. %) | 6.1 | 0.9 |
| Quinoline insolubles (wt. %) | 0.6 | less than 0.1 |
| Distillation (°C.) | | |
| IBP | 272 | 267 |
| 10 vol. % | 323 | 304 |
| 30 vol. % | 363 | 346 |
| 50 vol. % | 414 | 394 |

TABLE 3

| Experiment No. | 1 | 2 | 3 | 4 | 5 |
|---|---|---|---|---|---|
| Temperature of heat treatment (tubular heater) (°C.) | 470 | 490 | 500 | 510 | 520 |
| Yield (based on the refined heavy component) (wt. %) | | | | | |
| Insoluble component | 7.4 | 11.0 | 12.9 | 15.8 | 20.1 |
| Soluble component | 87.8 | 85.3 | 83.1 | 80.8 | 76.7 |
| Properties of Insoluble Component (wt. %) | | | | | |
| Xylene insolubles | 66.5 | 65.6 | 68.3 | 69.2 | 68.7 |
| Quinoline insolubles | 0.1 | 0.1 | 0.1 | 0.1 | 0.2 |

TABLE 4

| Experiment No. | 1 | 2 | 3 | 4 | 5 |
|---|---|---|---|---|---|
| Hydrogenated pitch | | | | | |
| Yield (based on refined heavy component) (wt. %) | 6.7 | 9.8 | 11.7 | 13.9 | 17.5 |
| Softening point (JIS Ring & Ball method) (°C.) | 145 | 143 | 144 | 143 | 142 |

TABLE 4-continued

| Experiment No. | 1 | 2 | 3 | 4 | 5 |
|---|---|---|---|---|---|
| Xylene insolubles (wt. %) | 57.3 | 55.4 | 54.6 | 54.1 | 53.8 |
| Quinoline insolubles (wt. %) | 0.2 | 0.2 | 0.3 | 0.3 | 0.4 |
| Optically anisotropic pitch | | | | | |
| Yield (based on refined heavy component) (wt. %) | 4.7 | 6.1 | 8.2 | 9.7 | 12.3 |
| Mettler method softening point (°C.) | 305 | 304 | 306 | 305 | 303 |
| Xylene insolubles (wt. %) | 92.3 | 95.1 | 94.8 | 94.2 | 93.2 |
| Quinoline insolubles (wt. %) | 0.6 | 0.7 | 0.8 | 1.0 | 1.3 |
| Content of optically anisotropic portion (%) | 95 | 100 | 100 | 100 | 98 |

TABLE 5

| Experiment No. | | 2 | 3 | 4 |
|---|---|---|---|---|
| Tensile strength | (kg/mm$^2$) | 289 | 294 | 307 |
| Modulus of elasticity | (ton/mm$^2$) | 16.5 | 16.4 | 16.1 |

TABLE 6

| Experiment No. | | 1 | 3 | 5 |
|---|---|---|---|---|
| Heat-treated pitch | | | | |
| Yield (based on refined heavy component) | (wt. %) | 18.6 | 17.9 | 16.8 |
| Softening point (Mettler method) | (°C.) | 266 | 261 | 258 |
| Xylene insolubles | (wt. %) | 63.7 | 61.6 | 60.8 |
| Quinoline insolubles | (wt. %) | less than 0.1 | less than 0.1 | less than 0.1 |
| Content of optically anisotropic portion | (%) | 0 | 0 | 0 |

TABLE 7

| Experiment No. | | 1 | 3 | 5 |
|---|---|---|---|---|
| Tensile strength | (kg/mm$^2$) | 107 | 101 | 109 |
| Modulus of elasticity | (ton/mm$^2$) | 5.9 | 5.7 | 5.3 |

EXAMPLE 2

The first step, i.e., a heat treatment in the tubular heater and removal of light fractions by distillation; the second step, i.e., separation of insoluble components newly formed and a solvent solution of soluble components, followed by washing of the insoluble components; and the sixth step, i.e., recovery of the soluble components by the solvent removal, were continuously carried out according to the scheme shown in FIG. 2 and using a refined heavy components produced in Example 1 as a raw material. In this example, the soluble components produced in the sixth step were recycled to the tubular heater in the first step in such an amount that the recycled soluble components be three times by weight of the amount of the refined heavy components. The operating conditions of each step were set as follows:

First Step

The amount of feed

| | |
|---|---|
| Refined heavy components: | 4.4 kg/hr |
| Recycled soluble components: | 13.2 kg/hr |
| Recycle ratio: | 3 |

Tubular heater:

A heating tube with an internal diameter of 6 mm and a length of 40 m immersed in a molten salt bath.

| | |
|---|---|
| Heating tube outlet temperature: | 500° C. |
| Heating tube pressure: | 20 Kg/cm$^2$ G |
| Distillation column: | |
| Packed column | |
| Column top temperature: | 290° C. |
| Pressure: | Atmospheric |

Second Step

Solvent: Xylene

Solvent ratio:

1.5 parts by weight per the thermally cracked heavy component obtained as the column bottom liquid when the heat-treated material of the first step is distilled.

Method of mixing the thermally cracked heavy component and the solvent:

Into a pipe in which thermally cracked heavy component flows at a temperature of about 100° C. under normal pressure, 1.5 times of xylene (based on the amount of the thermally cracked heavy component) was continuously added and the mixture was agitated at 50° C. within a small agitating and blending tank having an average residence time of 2 min, and then cooled to room temperature by a cooler.

Separation and recovery of the insoluble components:

Separator: A centrifuge (Mini-Decantor, made by Ishikawajima Harima Heavy Industries, Ltd.)

Conditions: Normal temperature and pressure

Washing of the insoluble components:

One (1) part of the insoluble component obtained from the centrifuge was added, mixed and dispersed into 2 parts of xylene at room temperature, and then filtered under pressure.

Sixth Step

Solvent recovery column:

Packed column

Column top temperature: 145° C.

Pressure: Atmospheric

The insoluble components produced by the above operation were heated under reduced pressure to eliminate xylene thus producing a high-molecular weight bituminous material at a yield of 25.3% by weight based on the refined heavy component. The bituminous material contained 69.9% by weight of xylene insoluble components and less than 0.1% by weight of quinoline insoluble components, and was completely isotropic when examined on a polarizing microscope. Analyses of the products produced in each step through this operation are shown in Table 8.

Next, 3 parts by weight of hydrogenated anthracene oil were added per 1 part by weight of this high-molecular weight bituminous material to dissolve the latter in former, and the solution was hydrogenated under the same conditions and using the same tubular heater as used in Example 1. Subsequently, the hydrogenated material (hydro-treated mixture) was subjected to flash distillation under the same conditions and using the same flash distillation column as used in Example 1 to produce hydrogenated pitch at a yield of 23.0% by weight based on the refined heavy component. The hydrogenated pitch contained 55.6% by weight of xylene insoluble components and 0.2% by weight of quinoline insoluble components, and possessed a softening point of 151° C. by JIS Ring and Ball method.

In the same way as in Example 1, the hydrogenated pitch was placed in a polymerization flask and heat-treated in a salt bath at a temperature of 450° C. under the atmospheric pressure for 30 minutes while bubbling nitrogen gas at a rate of 8 liters/min to produce an optically anisotropic pitch for the manufacture of high-performance carbon fibers at a yield of 16.4% by weight based on the refined heavy component. The pitch possessed a softening point of 304° C. by Mettler method and contained 95.8% by weight of xylene insoluble components and 0.7% by weight of quinoline insoluble components. The observation of the pitch under a polarizing microscope revealed that it comprised the optically anisotropic portion of almost 100%.

This optically anisotropic pitch was spun using the same spinning apparatus as used in Example 1 at a temperature of 330° C. at a winding speed of 700 m/min, infused under the same conditions as in Example 1, and carbonized at 1,000° C. to produce carbon fibers having strength of 315 Kg/mm$^2$ and modulus of elasticity of 17.8 ton/mm$^2$. The carbon fibers were graphitized in a nitrogen atmosphere at 2,500° C. to produce graphite fibers having tensile strength of 421 Kg/mm$^2$ and modulus of elasticity of 62.8 ton/mm$^2$.

Among the soluble components produced in the sixth step those not recycled to the tubular heater of the first step were submitted to distillation under a reduced pressure to remove the light fractions having a boiling point not higher than 350° C. (converted into normal pressure) and to produce a soluble pitch at a yield of 55.5% by weight based on the refined heavy component. The pitch possessed a softening point of 58° C. by JIS Ring and Ball method and contained less than 0.1% by weight of quinoline insoluble components.

Two hundred (200) grams each of the soluble pitch was placed in the same polymerization flask as used in Example 1, respectively, and heat-treated in a salt bath at a temperature of 430° C. under the atmospheric pressure for 60–120 minutes while bubbling nitrogen gas at a rate of 8 liters/min to produce heat-treated pitches for the manufacture of GP carbon fibers. The yield of the pitches based on the refined heavy component and its properties are shown in Table 9.

The heat-treated pitch of the Experiment No. 7 was spun using the same spinning apparatus as used in Example 1 at a temperature of 290° C. at a winding speed of 500 m/min, infused under the same conditions as in Example 1, and carbonized at 1,000° C. to produce carbon fibers having tensile strength of 110 Kg/mm$^2$ and modulus of elasticity of 5.8/ton mm$^2$.

TABLE 8

| | Thermally cracked heavy components | Soluble components |
|---|---|---|
| Specific gravity | 1.233 | 1.220 |
| Viscosity (cSt, 100° C.) | 119.5 | 46.4 |
| Xylene insolubles (wt. %) | 10.5 | 1.8 |
| Quinoline insolubles (wt. %) | less than 0.1 | less than 0.1 |
| Distillation (°C.) | | |
| IBP | 275 | 280 |
| 10 vol.% | 338 | 328 |
| 30 vol.% | 377 | 365 |
| 50 vol.% | 440 | 414 |

TABLE 9

| Experiment No. | | 6 | 7 | 8 |
|---|---|---|---|---|
| Heat treatment | (min) | 60 | 90 | 120 |
| Yield (based on the refined heavy component) | (wt. %) | 16.4 | 16.1 | 15.3 |
| Mettler method softening point | (°C.) | 255 | 263 | 277 |
| Xylene insolubles | (wt. %) | 59.6 | 60.9 | 67.1 |
| Quinoline insolubles | (wt. %) | less than 0.1 | less than 0.1 | less than 0.1 |
| Optically anisotropic portion | (%) | 0 | 0 | 0 |

EXAMPLE 3

The hydro-treated mixture obtained in the third step, i.e., a product hydrogenated with a hydrogen-donating solvent within a tubular heater, of Example 2 was immediately cooled to about 100° C. without sending it to a flash distillation column. The hydro-treated mixture was heat-treated by using the continuous dispersion-heat-treatment apparatus with the construction as shown in FIG. 1.

The dimensions of the continuous dispersion-heat-treatment apparatus are as follows: Internal diameter of the vessel was 100 mm, distance between one collecting pan and the next collecting pan was 130 mm, diameter of each rotating disk was 70 mm, diameter of the hole at the lower end of each collecting pan was 40 mm, and combinations of collecting pan and disk were eight-stages. The disks were fixed at a 60 mm-distance from the upper end of each collecting pan, i.e., from the flange.

The hydro-treated mixture mentioned above was charged to the apparatus in a rate of 6.5 kg/hr, and was heat-treated at a disk rotating rate of 800 rpm, at a nitrogen feed rate of 80 liters (as converted to the volume at room temperature)/min, under normal pressure, and at a temperature of 445° C., and the pitch for manufacturing high-performance carbon fibers, i.e., an optically anisotropic pitch, was discharged continuously from the bottom of the apparatus by a gear pump. The yield of the optically anisotropic pitch based on the refined heavy component was 16.3 wt %, and the properties were as follows: Mettler method softening point: 306° C.; xylene insolubles: 94.7%; quinoline insolubles: 0.5%. When observed on a polarizing microscope, the content of optically anisotropic portion was about 100%.

The optically anisotropic pitch was spun by using the spinning apparatus as used in Example 1 at a temperature of 335° C. and winding rate of 700 m/min, and the spun fiber was rendered infusible under the same condition as used in Example 1 and the fiber was carbonized at 1,000° C. Characteristics of the carbon fiber were as follows: Tensile strength: 318 kg/mm$^2$; modulus of elasticity: 17.5 ton/mm$^2$. Further, the carbon fiber was graphitized at 2,500° C. The characteristics of the graphite fiber thus obtained were as follows: Tensile strength: 430 kg/mm$^2$; modulus of elasticity: 61.4 ton/mm$^2$.

EXAMPLE 4

A continuous heat treatment was performed using the soluble components produced in Example 2 as a raw material in the same continuous dispersion-heat-treatment apparatus used in Example 3. The same operating conditions as used in Example 3 were employed, except that the raw material was fed at a rate of 5.0 kg/hr, nitrogen was charged at a rate of 120 normal liters/min, and a treatment temperature of 465° C. was used.

The yield of the heat-treated pitch which is a pitch for the manufacture of GP carbon fibers was 16.2% by weight based on the refined heavy component. The pitch possessed a softening point of 261° C. by Mettler method and contained 62.0% by weight of xylene insoluble components and not more than 0.1% by weight of quinoline insoluble components. The observation of the pitch on a polarizing microscope confirmed the complete absence of an optically anisotropic portion.

This heat-treated pitch was spun using the same spinning apparatus as used in Example 1 at a temperature of 290° C. at a winding speed of 500 m/min, infused under the same conditions as used in Example 1, and carbonized at 1,000° C. to produce carbon fibers having tensile strength of 108 kg/mm$^2$ and modulus of elasticity of 5.4 ton/mm$^2$.

EXAMPLE 5

The refined heavy component obtained in Example 1 was used as the starting raw material. By using the refined heavy component, the first step, i.e., a heat treatment and subsequent removal of light fractions by distillation; the second step, i.e., separation of insoluble components and solvent solution of soluble components; and the sixth step, i.e., recovery of soluble components by removal of the solvent with distillation, were continuously conducted. The treatments above were conducted in the same conditions as described in Example 2 except that the mixing ratio of xylene solvent and the thermal-cracked heavy component was changed to 2 parts of xylene/1 part of the thermal-cracked heavy component.

The insoluble component containing some amounts of xylene obtained in the second step per se, i.e., without subjecting the treatment for xylene removal, was blended with 1.6 times amounts of a hydrogenated anthracene oil (1.6 parts of the hydrogenated anthracene oil/1 part of the insoluble component) and then xylene was removed by distilling the mixture. A hydrogenation treatment was conducted by heat-treating the mixture thus obtained by using the same conditions and the same apparatus as those used in the third step of Example 1. The hydro-treated mixture thus obtained was heat-treated continuously in the continuous dispersion-heat-treatment apparatus used in Example 3, thereby obtained an optically anisotropic pitch for the production of high-performance carbon fibers. The heat treatment was conducted continuously under the same conditions as used in Example 3 except that the heat-treating temperature employed was 455° C.

Yield of the optically anisotropic pitch thus obtained based on the refined heavy component was 17.8%. The optically anisotropic pitch had following properties: Mettler method softening point: 308° C.; xylene insolubles: 94.7%; quinoline insolubles: 0.7%. When observed on a polarizing microscope, content of anisotropic portion was about 100%.

A carbon fiber was prepared from the optically anisotropic pitch through spinning and infusion, followed by carbonization at 1,000° C. under the same conditions as in Example 3. Characteristics of the carbon fiber as measured were: Tensile strength: 309 kg/mm$^2$; modulus of elasticity: 18.5 ton/mm$^2$.

In this operation, the amount of remaining portion of the soluble component not recycled to the tubular heater of the first step, i.e., the balance of soluble component obtained in the sixth step and the soluble component recycled to the tubular heater of the first step, was 59.4 wt. % based on the refined heavy component. The portion corresponding to 29.4 wt. % was removed from the system as by-product oil and the balance of 30.0 wt. % was heat-treated with a continuous dispersion-heat-treatment apparatus as used in Example 4, thereby obtained a heat-treated pitch as a pitch for the production of general purpose carbon fibers. The yield of the pitch was 6.6 wt. % based on the refined heavy component. The pitch had following properties: Mettler method softening point: 254° C.; xylene insolubles: 59.8 wt. %; and quinoline insolubles: less than 0.1 wt. %. When the pitch was examined on a polarizing microscope, the portion showing optical anisotropy was not observed, completely.

Carbon fibers were prepared from this heat-treated pitch in the same manner as described in Example 4, and the carbon fibers thus prepared had tensile strength of 96 kg/mm$^2$ and modulus of elasticity of 4.9 ton/mm$^2$.

EXAMPLE 6

The first step, i.e., heat treatment in a tubular heater followed by distillation of the light fractions; the second step, i.e., the separation of the insoluble components and the solvent solution of the soluble components; and the sixth step, i.e., recovery of the soluble components by the removal of the solvent with distillation were continuously carried out using the refined heavy component prepared in Example 1 under the same operating conditions as used in Example 5, except that the treatment by the tubular heater was carried out at a temperature of 480° C.

The insoluble components produced in the second step were mixed with a three-fold weight hydrogenated anthracene oil without removal of xylene. Xylene was removed from the mixture by distillation in the same way as in Example 5, and then the bottom fraction, i.e., a mixture of the insoluble components and the hydrogenated anthracene oil, was hydrogenated by the tubular heater of the third step, followed by the heat treatment in the continuous dispersion-heat-treatment apparatus of the integrated fourth and fifth steps to produce an optically anisotropic pitch.

The yield of the pitch was 13.8% by weight based on the refined heavy component. The pitch possessed a softening point of 305° C. by Mettler method and contained 93.5% by weight of xylene insoluble components and 0.1% by weight of quinoline insoluble components. The observation of the pitch on a polarizing microscope revealed that it comprised the optically anisotropic portion of almost 100%.

200 g of the soluble components produced in the sixth step which was not recycled to the first step tubular heater in this experiment was heat-treated using a polymerization flask in the same manner as in Example 1 under the conditions of atmospheric pressure on a salt bath heated at 450° C. for 40 minutes while bubbling nitrogen gas at a rate of 8 liters/min. The yield of the heat-treated pitch thus produced was 14.1% by weight based on the refined heavy component. The pitch possessed a softening point of 263° C. by Mettler method and contained 63.6% by weight of xylene insoluble components and less than 0.1% by weight of quinoline insoluble components. The observation of the pitch on a polarizing microscope revealed the complete absence of an optically anisotropic portion.

EXAMPLE 7

A commercially available coal tar with the properties shown in Table 10 was distilled at 280° C. under the atmospheric pressure to remove the light fraction therefrom, thereby obtained a pitch. To the pitch thus obtained twice by weight of xylene (i.e., 1 part of pitch/2 parts of xylene) was added and mixed to dissolution. The mixture was then submitted to continuous filtration to separate insoluble materials at normal temperature. Xylene was subsequently distilled off from the filtrate, thus obtained a refined heavy component with the properties shown in Table 10. The yield of the refined heavy component based on the coal tar was 70.0 wt. %.

The refined heavy component thus obtained was used as the starting raw material. By using the refined heavy component, the first step, i.e., a heat treatment in a first tubular heater and removal of light fractions by distillation; the second step, i.e., separation of the insoluble component newly formed and solvent solution of soluble component, and washing of the insoluble component; and the sixth step, i.e., recovery of soluble component from the solvent solution of soluble component by removal of solvent with distillation, were continuously conducted in accordance with the process as illustrated in FIG. 2. The soluble component obtained in the sixth step was recirculated into the first tubular heater of the first step in a rate so as to give the soluble component/-the refined heavy component weight ratio of 3/1. The operating conditions of each step were set as follows:

First step

Amount of the feed

| | |
|---|---|
| Refined heavy component: | 3.0 kg/hr |
| Recycled amount of soluble component: | 9.0 kg/hr |
| Recycle ratio: | 3 |

Tubular heater

A heating tube with internal diameter of 6 mm and length of 27.5 m dipped in a molten salt bath.

| | |
|---|---|
| Heating tube outlet temperature: | 510° C. |
| Heating tube outlet pressure: | 20 Kg/cm$^2$G |

Distillation column

| Flasher | |
|---|---|
| Temperature: | 290° C. |
| Pressure: | Normal pressure |

Second step

Solvent: Xylene

Solvent ratio: 2 parts/1 part of thermal-cracked heavy component obtained by flashing the heat-treated material produced in the first step (bottom fraction of the flasher)

Method for mixing of solvent and the thermal-cracked heavy component:

Into a pipe in which thermal-cracked heavy component flows at a temperature of about 100° C. under normal pressure, 2 times of xylene based on the amount of the thermal-cracked heavy component was continuously added and then cooled to room temperature by a cooler.

Separation and recovery of the insoluble component

Separator: Centrifuge (Mini-Decanter manufactured by Ishikawajima Harima Heavy Industries, Ltd.)

Conditions: Room temperature, normal pressure

Washing of insoluble component

One (1) part of the insoluble component obtained from the centrifuge was added, mixed and dispersed into 2 parts of xylene at room temperature, and then the mixture was centrifuged.

Sixth step

Solvent recovery column

| Packed column | |
|---|---|
| Temperature: | 145° C. |
| Pressure: | Normal pressure |

The yield based on refined heavy component of high-molecular weight bituminous material obtained from the insoluble component with removal of xylene by heating under a reduced pressure was 31.0 wt. %. The high-molecular weight bituminous material had following properties: Xylene insolubles: 74.7 wt. %; quinoline insolubles: 0.2 wt. %. When observed on a polarizing microscope, it showed isotropy in its entirety. During this operation, samples were taken from each step and analyzed. The results were shown in Table 11.

Then, 3 parts of a hydrogenated anthracene oil was added to 1 part of the high-molecular weight bituminous material to dissolution and then the mixture was heat-treated using the same conditions and the tubular heater as used in Example 1 to conduct hydrogenation, and a hydro-treated mixture was obtained. The hydro-treated mixture was distilled in the flash distillation column as used in Example 1 under the same conditions as used in Example 1, thus obtained a hydrogenated pitch. The yield of the hydrogenated pitch based on the refined heavy component was 26.9 wt. %, and the properties thereof were as follows: Softening point (JIS Ring and Ball method): 139° C.; xylene insolubles: 56.2 wt. %; and quinoline insolubles: 0.2 wt. %.

In the same ways in Example 1, 100 g of the hydrogenated pitch was placed in a polymerization flask and heat-treated in a salt bath at a temperature of 450° C. under the atmospheric pressure for 55 minutes while bubbling nitrogen gas at a rate of 8 liters/min to produce optically anisotropic pitch for the manufacture of high-performance carbon fibers at an yield of 20.2% by weight based on the refined heavy component. The pitch possessed a softening point of 302° C. by Mettler method and contained 95.1% by weight of xylene insoluble components and 3.4% by weight of quinoline insoluble components. The observation of the pitch on a polarizing microscope revealed that it comprised the optically anisotropic portion of almost 100%.

This optically anisotropic pitch was spun using the same spinning apparatus as used in Example 1 at a temperature of 330° C. at a winding speed of 700 m/min, infused under the same conditions as used in Example 1, and carbonized at 1,000° C. to produce carbon fibers having strength of 344 Kg/mm$^2$ and modulus of elasticity of 18.2 ton/mm$^2$. The carbon fibers were graphitized in a nitrogen atmosphere at 2,500° C. to produce graphite fibers having tensile strength of 438 Kg/mm$^2$ and modulus of elasticity of 67.2 ton/mm$^2$.

Among the soluble components produced in the sixth step those not recycled to the tubular heater of the first step were submitted to distillation under a reduced pressure to remove the light fractions having a boiling point not higher than 350° C. converted into the atmospheric pressure and to produce a soluble pitch at a yield of 39.0% by weight based on the refined heavy component. The pitch possessed a softening point of 62° C. by JIS Ring and Ball method and contained less than 0.1% by weight of quinoline insoluble components.

200 g of the soluble pitch was placed in the same polymerization flask as used in Example 1 and heat-treated in a salt bath at a temperature of 430° C. under the atmospheric pressure for 90 minutes while bubbling nitrogen gas at a rate of 8 liters/min to produce a pitch for the manufacture of GP carbon fibers. The yield of the pitch based on the refined heavy component was 11.5% by weight. The pitch possessed a softening point of 270° C. by Mettler method and contained 65.2% by weight of xylene insoluble components and less than 0.1% by weight of quinoline insoluble components. The observation of the pitch on a polarizing microscope confirmed complete absence of an optically anisotropic portion.

This heat-treated pitch was spun using the same spinning apparatus as used in Example 1 at a temperature of 290° C. at a winding speed of 500 m/min, infused under the same conditions as used in Example 1, and carbonized at 1,000° C. to produce carbon fibers having tensile strength of 113 Kg/mm$^2$ and modulus of elasticity of 6.3 ton/mm$^2$.

TABLE 10

| | Coal tar | Refined heavy component |
|---|---|---|
| Specific gravity | 1.157 | 1.162 |
| Viscosity (cSt, 100° C.) | 28.0 | 48.4 |
| Xylene insolubles (wt. %) | 7.2 | 0.8 |
| Quinoline insolubles (wt. %) | 1.0 | less than 0.1 |
| Distillation (°C.) | | |
| IBP | 226 | 248 |
| 10 vol. % | 279 | 309 |
| 30 vol. % | 332 | 346 |
| 50 vol. % | 397 | 389 |

TABLE 11

| | Thermal-cracked heavy component | Soluble component |
|---|---|---|
| Specific gravity | 1.228 | 1.184 |
| Viscosity (cSt, 100° C.) | 135.4 | 31.4 |
| Xylene insolubles (wt. %) | 7.4 | 1.7 |
| Quinoline insolubles (wt. %) | less than 1.0 | less than 0.1 |
| Distillation (°C.) | | |
| IBP | 235 | 233 |
| 10 vol. % | 314 | 304 |
| 30 vol. % | 363 | 354 |
| 50 vol. % | 416 | 400 |

EXAMPLE 8

An optically anisotropic pitch for the manufacture of high-performance carbon fibers and heat-treated pitch for the manufacture of GP carbon fibers were prepared using the refined heavy component obtained in Example 1 as the raw material and under the same conditions as used in Example 2, except that 5 parts by weight of the soluble component produced in the sixth step were recycled to the tubular heater of the first step for 1 part of the refined heavy component, and further that the duration for the heat treatment of the hydrogenated pitch and the soluble pitch in the polymerization flask was 40 minutes and 90 minutes, respectively. The yields based on the refined heavy component and properties of the pitches are shown in Table 12.

TABLE 12

| | | Optically anisotropic pitch | Heat-treated pitch |
|---|---|---|---|
| Yield | (wt. %) | 21.8 | 10.2 |
| Softening point (Mettler method) | (°C.) | 309 | 259 |
| Xylene insolubles | (wt. %) | 94.2 | 61.6 |
| Quinoline insolubles | (wt. %) | 0.9 | less than 0.1 |
| Optically anisotropic portion | (%) | 100 | 0 |

EXAMPLE 9

A commercially available coal tar with the properties shown in Table 13 was distilled at 280° C. under the atmospheric pressure to remove the light fraction therefrom, thereby obtained a pitch. To the pitch thus obtained twice by weight of xylene (i.e., 1 part of pitch/2 parts of xylene) was added and mixed to dissolution. The mixture was then submitted to a continuous filtration to separate insoluble materials at normal temperature. Xylene was subsequently distilled off from the filtrate, thus obtained a refined heavy component with the properties shown in Table 13. The yield of refined heavy component based on the coal tar was 69.7 wt. %.

The refined heavy component thus obtained was used as the starting raw material. By using the refined heavy component, the first step, i.e., a heat treatment in a first tubular heater and removal of light fractions by distillation; the second step, i.e., separation of the insoluble component newly formed and solvent solution of soluble component, and washing of the insoluble component; and the sixth step, i.e., recovery of soluble component from the solvent solution of soluble component by removal of solvent with distillation, were continuously conducted in accordance with the process as illustrated in FIG. 2. The soluble component obtained in the sixth step was recirculated into the first tubular heater of the first step in a rate so as to give the soluble component/-the refined heavy component weight ratio of 3/1. Further, to 1 part of the combined feed of fresh feed (refined heavy component) and soluble component recycled, 0.5 part of a wash oil was added. The wash oil had specific gravity of 1.053, 10 vol. % boiling point of 245° C. and 90 vol. % boiling point of 277° C. The wash oil was obtained from coal tar by distillation. The wash oil added in the first step was separated and removed in the flash distillation column. Yield of the thermal-cracked heavy component based on the refined heavy component was 101%. The value, 101%, showed that the wash oil added was partly remained in the thermal-cracked heavy component.

The operating conditions of each step were set as follows:

First step

Amount of the feed

| | |
|---|---|
| Refined heavy component: | 3.0 kg/hr |
| Recycled amount of soluble component: | 9.0 kg/hr |
| Recycle ratio: | 3 |

-continued

| | |
|---|---|
| Wash oil (diluent): | 6.0 kg/hr |

Tubular heater

A heating tube with internal diameter of 6 mm and length of 40 m dipped in a molten salt bath.

| | |
|---|---|
| Heating tube outlet temperature: | 510° C. |
| Heating tube outlet pressure: | 20 Kg/cm$^2$G |

Distillation column

| Flasher | |
|---|---|
| Temperature: | 280° C. |
| Pressure: | Normal pressure |

Second step

Solvent: Xylene

Solvent ratio: 2 parts/1 part of thermal-cracked heavy component obtained in the first step (bottom fraction of the flasher)

Method for mixing of solvent and the thermal-cracked heavy component:

Into a pipe in which thermal-cracked heavy component flows at a temperature of about 100° C. under normal pressure, 2 times of xylene (based on the amount of the thermal-cracked heavy component) was continuously added and then cooled to room temperature by a cooler.

Separation and recovery of the insoluble component

Separator: Centrifuge (Mini-Decanter manufactured by Ishikawajima Harima Heavy Industries, Ltd.)

Conditions: Room temperature, normal pressure

Washing of insoluble component

One (1) part of the insoluble component obtained from the centrifuge was added, mixed and dispersed into 2 parts of xylene at room temperature, and then the mixture was centrifuged

Sixth step

Solvent recovery column

| Packed column | |
|---|---|
| Temperature: | 145° C. |
| Pressure: | Normal pressure |

The yield based on refined heavy component of high-molecular weight bituminous material obtained from the insoluble component with removal of xylene by heating under a reduced pressure was 19.9%. The high-molecular weight bituminous material had following properties: Xylene insolubles: 73.5%; quinoline insolubles: 0.1%. When observed on a polarizing microscope, it showed isotropy in its entirety. During this operation, samples were taken from each step and analyzed. The results were shown in Table 14.

Then, 3 parts of a hydrogenated anthracene oil was added to 1 part of the high-molecular weight bituminous material to dissolution and then the mixture was heat-treated using the same conditions and the tubular heater as used in Example 1 to conduct hydrogenation, and a hydro-treated mixture was obtained. The hydro-treated mixture was heat-treated by using the continuous dispersion-heat-treatment apparatus with the construction as described in Example 3. Conditions used in the heat treatment were identical with those used in Example 3, except that heat-treating temperature was changed to 449° C. Thus, an optically anisotropic pitch was obtained.

Yield of the optically anisotropic pitch based on the refined heavy component was 11.9%. The optically anisotropic pitch had following properties: Mettler method softening point: 300° C.; xylene insolubles: 92.8%; and quinoline insolubles: 0.6%. When observed on a polarizing microscope, the pitch had an optically anisotropic portion of nearly 100%.

The optically anisotropic pitch was spun into a fiber by using the spinning apparatus as used in Example 1 at a temperature of 325° C. and winding speed of 700 m/min, and the spun fiber was rendered infusible under the same condition as used in Example 1 and the fiber was carbonized at 1,000° C. Characteristics of the carbon fiber were as follows: Tensile strength: 328 $Kg/mm^2$; modulus of elasticity: 16.6 $ton/mm^2$.

A heat-treated pitch was obtained from the remaining portion of the soluble component obtained in the sixth step not recycled to the tubular heater of the first step (i.e., the balance of the soluble component obtained in the sixth step and the soluble component recycled to the tubular heater of the first step) by using the same continuous dispersion-heat-treatment apparatus used in Example 3. The experiment was conducted in the same conditions as used in Example 4, except that feeding rate of raw material, i.e., soluble component, was changed to 4.5 kg/hr and heat-treating temperature was changed to 460° C. The yield of the heat-treated pitch based on the refined heavy component was 12.5 wt. % and the ptich had following properties: Mettler method softening point: 259° C.; xylene insolubles: 61.7 wt. %; and quinoline insolubles: less than 0.1 wt. %. When the pitch was examined on a polarizing microscope, optically anisotropic portion was not observed completely.

The pitch was spun into fiber by using the same spinning apparatus as used in Example 1 at 285° C. and at a winding rate of 500 m/min. The pitch fiber thus obtained was rendered infusible under the same conditions as used in Example 1 and carbonized at 1,000° C. The carbon fiber had a tensile strength of 121 $kg/mm^2$ and a modulus of elasticity of 5.8 $ton/mm^2$.

TABLE 13

| | Coal Tar | Refined Heavy Component |
|---|---|---|
| Specific gravity | 1.164 | 1.181 |
| Viscosity (cSt, 100° C.) | 5.1 | 28.3 |
| Xylene insolubles (wt. %) | 4.7 | 1.9 |
| Quinoline insolubles (wt. %) | 0.6 | less than 0.1 |
| Distillation (°C.) | | |
| IBP | 189 | 220 |
| 10 vol. % | 221 | 304 |
| 30 vol. % | 322 | 372 |
| 50 vol. % | 401 | 439 |

TABLE 14

| | Thermal-Cracked Heavy Component | Soluble Component |
|---|---|---|
| Specific gravity | 1.195 | 1.188 |
| Viscosity (cSt, 100° C.) | 23.8 | 19.0 |
| Xylene insolubles (wt. %) | 6.1 | 2.1 |
| Quinoline insolubles (wt. %) | less than 0.1 | less than 0.1 |
| Distillation (°C.) | | |
| IBP | 222 | 219 |

TABLE 14-continued

| | Thermal-Cracked Heavy Component | Soluble Component |
|---|---|---|
| 10 vol. % | 253 | 250 |
| 30 vol. % | 345 | 342 |
| 50 vol. % | 427 | 405 |

We claim:

1. A process for producing a pitch for the manufacture of high-performance carbon fibers together with a pitch for the manufacture of general-purpose carbon fibers, which comprises using, as a raw material, a heavy oil of coal origin or petroleum origin, or a heavy component obtained by the distillation, heat treatment or hydrogenation of the heavy oil of coal origin or petroleum origin, which contains essentially no component insoluble in a monocyclic aromatic hydrocarbon solvent or from which such component insoluble in a monocyclic aromatic hydrocarbon solvent has been essentially removed;

subjecting said raw material to a first step of continuously heat-treating said raw material in a tubular heater under an increased pressure at a temperature of 400°–600° C. to produce a heat-treated material containing essentially no quinoline insoluble component and 3–30% by weight of xylene insoluble component;

subjecting said heat-treated material produced in the first step to a second step of adding 1–5 parts by weight of a monocyclic aromatic hydrocarbon solvent or a solvent having the same degree of dissolving ability with the monocyclic aromatic hydrocarbon solvent to 1 part by weight of said heat-treated material, thus producing insoluble component and separating the insoluble component and the solution of soluble component in said solvent;

subjecting said insoluble component separated in the second step to a third step of hydrogenating said insoluble component with heating in the presence of a hydrogen-donating solvent to produce a hydro-treated mixture;

thereby obtaining a hydro-treated mixture from the third step and obtaining a solution of soluble component in the monocyclic aromatic hydrocarbon solvent from the second step;

treating said hydro-treated mixture to produce a substantially optically anisotropic pitch for the manufacture of high-performance carbon fibers; and treating said solution of soluble component in said solvent to produce an essentially optically isotropic pitch for the manufacture of general-purpose carbon fibers.

2. A process according to claim 1, wherein said treatment of said hydro-treated mixture which is produced in the third step comprises:

a fourth step of removing said hydrogen-donating solvent and a portion of light fraction from hydro-treated mixture to produce a hydrogenated pitch which is essentially optically isotropic; and a fifth step of heat-treating said hydrogenated pitch which is essentially optically isotropic to produce a substantially optically anisotropic pitch for the manufacture of high-performance carbon fibers: and said treatment of said solution of soluble component in said solvent which is produced in the second step comprises:

a sixth step of removing said monocyclic aromatic hydrocarbon solvent or the solvent having the same degree of dissolving ability with the monocyclic aromatic hydrocarbon solvent from said solution of soluble component to obtain soluble component;

a seventh step of removing light fraction from said soluble component obtained in the sixth step to produce a soluble pitch; and an eighth step of heat-treating said soluble pitch produced in the seventh step to produce a heat-treated pitch which is an essentially optically isotropic pitch for the manufacture of general-purpose carbon fibers.

3. A process according to claim 1, wherein the separation of the insoluble component and the solution of soluble component in the second step is carried out continuously.

4. A process according to claim 2, wherein said heat treatment of the raw material in a tubular heater in the first step is carried out in the presence of an aromatic oil which has a boiling point range of 200°–350° C. and produces essentially no component insoluble in the monocyclic aromatic hydrocarbon solvent by said heat treatment.

5. A process according to claim 4, wherein said raw material contains 10–70% by weight of said aromatic oil.

6. A process according to claim 4, wherein 1 part by weight or less aromatic oil is added to 1 part by weight of said raw material.

7. A process according to claim 2, wherein the heat-treated material produced in the first step is fed to the second step after removal of cracked gas and a part of light fraction.

8. A process according to claim 7, wherein said removal of cracked gas and a part of light fraction is conducted by distillation or flash distillation at a temperature of 200°–350° C. under a pressure of 0–3 $Kg/cm^2A$.

9. A process according to claim 2, wherein the fourth and fifth steps are combined together to constitute an integral continuous dispersion-heat-treatment step, wherein the hydro-treated mixture obtained in the third step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°–500° C., thereby removing the hydrogen-donating solvent and the light fraction and, at the same time, converting the essentially optically isotropic hydrogenated pitch contained in the hydro-treated mixture into a substantially optically anisotropic pitch.

10. A process according to claim 2, wherein the seventh and eighth steps are combined together to constitute an integral continuous dispersion-heat-treatment step, wherein the soluble component obtained in the sixth step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°–500° C., thereby removing the light fraction and, at the same time, converting the soluble pitch contained in the soluble component into an essentially optically isotropic heat-treated pitch.

11. A process according to claim 2, wherein the sixth, seventh and eighth steps are combined together to constitute an integral continuous dispersion-heat-treatment step, wherein said solution of the soluble component obtained in the second step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°–500° C., thereby removing monocyclic aromatic hydrocarbon solvent or the solvent having the same degree of dissolving ability with the monocyclic aromatic hydrocarbon solvent and the light fraction and, at the same time, converting the soluble pitch contained in the solution of soluble component into an essentially optically isotropic heat-treated pitch.

12. A process according to claim 2, wherein a portion of the soluble component obtained in the sixth step is submitted to the seventh step or a combination of the seventh and eighth steps by the use of a continuous dispersion-heat-treatment, and at least a portion of the remaining portion of the soluble component is recycled to the first step as a heat treatment raw material.

13. A process according to claim 2, wherein a portion of the solution of the soluble component in the solvent obtained in the second step is submitted to a combination of the sixth, seventh and eighth steps by the use of a continuous dispersion-heat-treatment, and at least a portion of the remaining portion of the solution is recycled to the first step as a heat treatment raw material after the removal of the monocyclic aromatic hydrocarbon solvent or the solvent having the same degree of dissolving ability with the monocyclic aromatic hydrocarbon solvent therefrom.

14. A process according to claim 2, wherein the heavy oil which is by-produced in the heat treatment of the fifth step or a heavy oil obtained by removing the hydrogen-donating solvent from a mixture of the hydrogen-donating solvent and the heavy oil, which is by-produced in the continuous dispersion-heat-treatment step which is an integral step of the fourth and fifth steps, is recycled to the first step as a heat treatment raw material.

15. A process according to claim 2, wherein a portion of the insoluble component which is separated in the second step is submitted to the third step and the remaining portion of the insoluble component is charged to the seventh step or a continuous dispersion-heat-treatment step which is an integral step of the seventh and eighth steps.

16. A process according to claim 2, wherein a portion of the heat-treated material obtained from the first step is submitted to the second step and the remaining portion of the heat-treated material is fed as a raw material to the seventh step or a continuous dispersion-heat-treatment step which is an integral step of the seventh and eighth steps.

17. A process according to claim 2, wherein a portion of the raw material for the first step is directly fed as a raw material to the seventh step or the continuous dispersion-heat-treatment step which is an integral step of the seventh and eighth steps, without being fed to the first step.

18. A process according to claim 9, wherein the seventh and eighth steps are combined together to constitute an integral continuous dispersion-heat-treatment step, wherein the soluble component obtained in the sixth step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°-500° C., thereby removing the light fraction and, at the same time, converting the soluble pitch contained in the soluble component into an essentially optically isotropic heat-treated pitch.

19. A process according to claim 9, wherein the sixth, seventh and eighth steps are combined together to constitute an integral continuous dispersion-heat-treatment step, wherein said solution of the soluble component obtained in the second step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°-500° C., thereby removing monocyclic aromatic hydrocarbon solvent or the solvent having the same degree of dissolving ability with the monocyclic aromatic hydrocarbon solvent and the light fraction and, at the same time, converting the soluble pitch contained in the solution of soluble component into an essentially optically isotropic heat-treated pitch.

20. A process according to claim 9, wherein a portion of the soluble component obtained in the sixth step is submitted to the seventh step or a combination of the seventh and eighth steps by the use of a continuous dispersion-heat-treatment, and at least a portion of the remaining portion of the soluble component is recycled to the first step as a heat treatment raw material.

21. A process according to claim 10, wherein a portion of the soluble component obtained in the sixth step is submitted to the combination of the seventh and eighth steps by the use of the continuous dispersion-heat-treatment, and at least a portion of the remaining portion of the soluble component is recycled to the first step as a heat treatment raw material.

22. A process according to claim 9, wherein a portion of the solution of the soluble component in the solvent obtained in the second step is submitted to a combination of the sixth, seventh and eighth steps by the use of a continuous dispersion-heat-treatment, and at least a portion of the remaining portion of the solution is recycled to the first step as a heat treatment raw material after the removal of the monocyclic aromatic hydrocarbon solvent or the solvent having the same degree of dissolving ability with the monocyclic aromatic hydrocarbon solvent therefrom.

23. A process according to claim 11, wherein a portion of the solution of the soluble component in the solvent obtained in the second step is submitted to a combination of the sixth, seventh and eighth steps by the use of the continuous dispersion-heat-treatment, and at least a portion of the remaining portion of the solution is recycled to the first step as a heat treatment raw material after the removal of the monocyclic aromatic hydrocarbon solvent or the solvent having the same degree of dissolving ability with the monocyclic aromatic hydrocarbon solvent therefrom.

24. A process according to claim 9, wherein a heavy oil obtained by removing the hydrogen-donating solvent from a mixture of the hydrogen-donating solvent and the heavy oil, which is by-produced in the continuous dispersion-heat-treatment step which is an integral step of the fourth and fifth steps, is recycled to the first step as a heat treatment raw material.

25. A process according to claim 12, wherein a heavy oil which is by-produced in the heat treatment of the fifth step or a heavy oil obtained by removing the hydrogen-donating solvent from a mixture of the hydrogen-donating solvent and the heavy oil, which is by-produced in a continuous dispersion-heat-treatment step which is an integral step of the fourth and fifth steps, is recycled to the first step as a heat treatment raw material.

26. A process according to claim 13, wherein a heavy oil which is by-produced in the heat treatment of the fifth step or a heavy oil obtained by removing the hydrogen-donating solvent from a mixture of the hydrogen-donating solvent and the heavy oil, which is by-produced in a continuous dispersion-heat-treatment step which is an integral step of the fourth and fifth steps, is recycled to the first step as a heat treatment raw material.

27. A process according to claim 20, wherein a heavy oil obtained by removing the hydrogen-donating solvent from a mixture of the hydrogen-donating solvent and the heavy oil, which is by-produced in the continuous dispersion-heat-treatment step which is an integral step of the fourth and fifth steps, is recycled to the first step as a heat treatment raw material.

28. A process according to claim 21, wherein a heavy oil which is by-produced in the heat treatment of the fifth step or a heavy oil obtained by removing the hydrogen-donating solvent from a mixture of the hydrogen-donating solvent and the heavy oil, which is by-produced in a continuous dispersion-heat-treatment step which is an integral step of the fourth and fifth steps, is recycled to the first step as a heat treatment raw material.

29. A process according to claim 22, wherein a heavy oil obtained by removing the hydrogen-donating solvent from a mixture of the hydrogen-donating solvent and the heavy oil, which is by-produced in the continuous dispersion-heat-treatment step which is an integral step of the fourth and fifth steps, is recycled to the first step as a heat treatment raw material.

30. A process according to claim 23, wherein a heavy oil which is by-produced in the heat treatment of the fifth step or a heavy oil obtained by removing the hydrogen-donating solvent from a mixture of the hydrogen-donating solvent and the heavy oil, which is by-produced in the continuous dispersion-heat-treatment step which is an integral step of the fourth and fifth steps, is recycled to the first step as a heat treatment raw material.

31. A process according to claim 9, wherein a portion of the insoluble component which is separated in the second step is submitted to the third step and the remaining portion of the insoluble component is charged to the seventh step or a continuous dispersion-heat-treatment step which is an integral step of the seventh and eighth steps.

32. A process according to claim 10, wherein a portion of the insoluble component which is separated in the second step is submitted to the third step and the remaining portion of the insoluble component is charged to the continuous dispersion-heat-treatment step which is an integral step of the seventh and eighth steps.

33. A process according to claim 9, wherein a portion of the heat-treated material obtained from the first step is submitted to the second step and the remaining portion of the heat-treated material is fed as a raw material to the seventh step or a continuous dispersion-heat-treatment step which is an integral step of the seventh and eighth steps.

34. A process according to claim 10, wherein a portion of the heat-treated material obtained from the first step is submitted to the second step and the remaining portion of the heat-treated material is fed as a raw material to the continuous dispersion-heat-treatment step which is an integral step of the seventh and eighth steps.

35. A process according to claim 9, wherein a portion of the raw material for the first step is directly fed as a raw material to the seventh step or a continuous dispersion-heat-treatment step which is an integral step of the seventh and eighth steps, without being fed to the first step.

36. A process according to claim 10, wherein a portion of the raw material for the first step is directly fed as a raw material to the continuous dispersion-heat-treatment step which is an integral step of the seventh and eighth steps, without being fed to the first step.

37. A process according to claim 4, wherein the fourth and fifth steps are combined together to constitute an integral continuous dispersion-heat-treatment step, wherein the hydro-treated mixture obtained in the third step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°-500° C., thereby removing the hydrogen-donating solvent and the light fraction and, at the same time, converting the essentially optically isotropic hydrogenated pitch contained in the hydro-treated mixture into a substantially optically anisotropic pitch; and a portion of the soluble component obtained in the sixth step is submitted to the seventh step or a combination of the seventh and eighth steps by the use of a continuous dispersion-heat-treatment, and at least a portion of the remaining portion of the soluble component is recycled to the first step as a heat treatment raw material.

38. A process according to claim 37, wherein the seventh and eighth steps are combined together to constitute an integral continuous dispersion-heat-treatment step, wherein the soluble component obtained in the sixth step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°-500° C., thereby removing the light fraction and, at the same time, converting the soluble pitch contained in the soluble component into an essentially optically isotropic heat-treated pitch.

39. A process according to claim 4, wherein the fourth and fifth steps are combined together to constitute an integral continuous dispersion-heat-treatment step, wherein the hydro-treated mixture obtained in the third step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°-500° C., thereby removing the hydrogen-donating solvent and the light fraction and, at the same time, converting the essentially optically isotropic hydrogenated pitch contained in the hydro-treated mixture into a substantially optically anisotropic pitch; and a portion of the solution of the soluble component in the solvent obtained in the second step is submitted to a combination of the sixth, seventh and eighth steps by the use of a continuous dispersion-heat-treatment, and at least a portion of the remaining portion of the solution is recycled to the first step as a heat treatment raw material after the removal of the monocyclic aromatic hydrocarbon solvent or the solvent having the same degree of dissolving ability with the monocyclic aromatic hydrocarbon solvent therefrom.

40. A process according to claim 39, wherein the sixth, seventh and eighth steps are combined together to constitute an integral continuous dispersion-heat-treatment step, wherein said solution of the soluble component obtained in the second step is dispersed as fine oil droplets in an inert gas stream or a super-heated vapor stream to cause the fine oil droplets and the inert gas stream or the super-heated vapor stream to come into contact with each other under a reduced or the atmospheric pressure at 350°-500° C., thereby removing monocyclic aromatic hydrocarbon solvent or the solvent having the same degree of dissolving ability with the monocyclic aromatic hydrocarbon solvent and the light fraction and, at the same time, converting the soluble pitch contained in the solution of soluble component into an essentially optically isotropic heat-treated pitch.

* * * * *